US012527392B1

(12) United States Patent
Willson, Jr. et al.

(10) Patent No.: US 12,527,392 B1
(45) Date of Patent: Jan. 20, 2026

(54) SYSTEMS, DEVICES, AND METHODS FOR ORGANIZING, TRANSPORTING, AND STORING ITEMS

(71) Applicants: Derick V. Willson, Jr., Newington, NH (US); David F. Willson, San Francisco, CA (US)

(72) Inventors: Derick V. Willson, Jr., Newington, NH (US); David F. Willson, San Francisco, CA (US)

( * ) Notice: Subject to any disclaimer, the term of this patent is extended or adjusted under 35 U.S.C. 154(b) by 81 days.

(21) Appl. No.: 17/308,734

(22) Filed: May 5, 2021

(51) Int. Cl.
*A45F 5/10* (2006.01)
*A47G 25/14* (2006.01)

(52) U.S. Cl.
CPC ..... *A45F 5/10* (2013.01); *A47G 25/1457* (2013.01); *A45F 2005/1086* (2013.01)

(58) Field of Classification Search
CPC ..... A47G 25/1457; A45F 2005/1086; A45F 5/10; A45F 2005/1033; A45F 5/102; Y10S 224/927; Y10S 248/911
See application file for complete search history.

(56) References Cited

U.S. PATENT DOCUMENTS 2,277,332 A * 3/1942 Lamb ..... A47G 25/0664 211/171
2,728,503 A 12/1955 Kramer
2,746,661 A * 5/1956 Kaplan ..... B60R 7/10 224/927
3,138,259 A * 6/1964 Sitt ..... A47F 7/02 211/85.2
3,317,055 A * 5/1967 Roscicki ..... A47G 25/1457 211/124
3,507,402 A * 4/1970 Barbee ..... A47F 7/24 280/35
3,549,065 A * 12/1970 Schubert ..... A47G 25/1457 294/143
3,578,226 A 5/1971 Good
3,606,967 A 9/1971 Roberts
3,633,802 A 1/1972 Webster
3,708,093 A * 1/1973 Toms ..... B60R 7/10 224/927

(Continued)

FOREIGN PATENT DOCUMENTS

CA 2548241 A1 * 11/2007 ..... A45F 5/1026
CN 208017044 U * 10/2018

(Continued)

*Primary Examiner* — Jack W Lavinder
*Assistant Examiner* — Matthew J Sullivan
(74) *Attorney, Agent, or Firm* — Maura K. Moran; Cambridge Technology Law LLC

(57) ABSTRACT

Method, systems, and devices for transportation and storage of items such as clothing are disclosed. An item storage system may have an item holder, which may be an item carrier, and a base onto which the item carrier is releasably attachable. The item carrier may have a cross-piece sized to hold and carry a first plurality of items across the cross-piece and a handle having a hand-graspable section between a far end and a near end that is attachable to the cross-piece. The cross-piece may have a plurality of partitions disposed along its length, at least one partition having a first compartment sized to secure a first item within the partition.

35 Claims, 28 Drawing Sheets

(56) References Cited

U.S. PATENT DOCUMENTS 3,731,809 A * 5/1973 Saenger ..... A47G 25/1457 294/143
3,744,600 A * 7/1973 Belland ..... A47G 25/54 294/142
3,799,416 A * 3/1974 Schmaltz ..... A47G 25/1457 294/142
3,804,310 A * 4/1974 Wheeler ..... A45B 3/06 294/142
3,848,787 A * 11/1974 Hill ..... A47G 25/1457 294/146
D242,598 S * 12/1976 Kunstlicher ..... B65H 75/06 D8/358
D247,085 S 1/1978 Stoddard
4,128,196 A 12/1978 Hill
4,238,062 A * 12/1980 Wheeler ..... A47G 25/1457 294/142
4,284,219 A * 8/1981 Standel, Jr. ..... A47G 25/1457 294/143
4,296,959 A * 10/1981 Helbig ..... A47G 25/1457 294/169
4,335,839 A * 6/1982 Kessler ..... A45F 5/102 294/142
4,420,178 A * 12/1983 Taylor ..... A45F 5/1026 D8/320
4,778,089 A * 10/1988 White ..... B60R 7/10 224/927
4,863,081 A * 9/1989 Gabbert ..... B60R 7/10 224/927
4,940,174 A * 7/1990 Parker ..... A47G 25/1457 224/257
D314,150 S * 1/1991 Preciutti ..... D9/434
5,104,083 A * 4/1992 Shannon ..... B60R 7/10 224/927
5,181,757 A * 1/1993 Montoya ..... A45F 5/1026 294/170
5,328,068 A * 7/1994 Shannon ..... A47G 25/1457 224/927
5,370,248 A * 12/1994 Robolin ..... A47G 25/0664 248/188.7
5,398,984 A * 3/1995 Elder ..... B60R 7/10 294/142
5,507,544 A * 4/1996 McQuade ..... A45F 5/1026 220/759
D369,470 S 5/1996 Suggs
5,524,948 A * 6/1996 Bostwick ..... A47G 25/1457 294/142
5,645,306 A * 7/1997 Kosteniuk ..... A45F 5/1026 D9/434
D388,326 S * 12/1997 Gurry ..... D9/434
5,833,081 A * 11/1998 Smith ..... B60R 7/10 224/313
5,890,689 A * 4/1999 Johnson ..... B60R 7/10 224/927
5,904,388 A * 5/1999 Seibel ..... A45C 13/28 294/169
5,951,080 A * 9/1999 Wessner ..... F16G 11/06 294/153
5,992,803 A * 11/1999 LeRoux ..... A45F 5/1026 D9/434
6,045,019 A * 4/2000 Moses ..... A45F 5/1026 294/170
6,247,739 B1 * 6/2001 Lyon ..... A45F 5/1026 294/159
6,317,924 B1 * 11/2001 Gallagher ..... A45C 13/26 16/113.1
6,382,549 B1 * 5/2002 Krake ..... A45F 5/102 242/405.2
7,125,061 B1 * 10/2006 Hajianpour ..... A45F 5/1026 294/169
7,134,561 B2 * 11/2006 Schneider ..... A47G 25/1457 211/124
7,328,925 B1 * 2/2008 Jenkins ..... A45F 5/1026 294/159
D583,155 S * 12/2008 Melfi ..... D3/328
7,740,297 B2 * 6/2010 Howie ..... A47G 25/1457 294/142
8,393,482 B2 * 3/2013 Durham ..... D06F 59/02 248/163.1
D755,043 S * 5/2016 Bailey ..... D8/394
9,360,158 B1 * 6/2016 Obenauf ..... A45F 5/102
9,387,810 B1 * 7/2016 Bishop ..... A47F 5/0006
9,539,851 B1 * 1/2017 Tanda ..... B44D 3/14
10,076,195 B2 * 9/2018 Winikoff ..... A47F 5/13
10,330,252 B2 * 6/2019 Abohammdan ..... F16M 13/02
10,702,050 B1 * 7/2020 Hames ..... A45F 5/1026
D935,308 S * 11/2021 Liu ..... D8/356
11,350,727 B1 * 6/2022 Schantz ..... A45F 5/1046
11,445,842 B1 * 9/2022 Harshbarger ..... G09F 3/16
D977,949 S * 2/2023 Li ..... D8/356
D991,780 S * 7/2023 Michael ..... D8/356
2007/0170738 A1 * 7/2007 Bongard ..... A45F 5/1046 294/168
2008/0018126 A1 * 1/2008 Jenkins ..... A45F 5/1026 294/158
2009/0206621 A1 * 8/2009 Payne ..... A45F 5/1026 294/158
2011/0095553 A1 * 4/2011 Meckwood ..... A45F 5/102 294/158
2017/0065068 A1 * 3/2017 Martinez ..... A45F 5/102
2022/0110427 A1 * 4/2022 Mennecke ..... A45C 13/28

FOREIGN PATENT DOCUMENTS

CN 208160368 U * 11/2018
GB 2594992 A * 11/2021 ..... B62B 5/069

* cited by examiner

SYSTEMS, DEVICES, AND METHODS FOR ORGANIZING, TRANSPORTING, AND STORING ITEMS

CROSS-REFERENCE TO RELATED APPLICATION none

FIELD

The present invention relates to the field of item storage, organizational, and storage units and carriers, and particularly to units and carriers for carrying, organizing, and storing clothing.

BACKGROUND

This invention relates to systems, methods and devices for transportation and short-to-long-term storage and organizing of items such as clothing. Note: "clothing" is a general term used in this document to refer to all of the types of items that may need be organized and stored, and carried from place to place.

People typically move items such as personal possessions or project supplies from one location to another, and have a need to keep items organized and stored for short or long periods of time while in transport. For example, whether a person lives in a house, apartment, or condo, we all need to move laundry to or from laundry facilities. Having a convenient and cost-effective way to transport clean laundry from the laundry facilities, and especially to store the clean laundry organized and unrumpled for short or long periods of time, is desirable.

Various devices have been proposed in the art such as is disclosed in U.S. Pat. No. 2,728,503, to Murray B. Kramer, which shows a hanger support, in combination with an upright post, with lugs and recesses on the support to receive clothes hangers, and in U.S. Pat. No. 3,578,226, to Frederick H. Good, which shows a hand-held carrier for hung clothes having a flattened end with an elongated opening sized to receive hangers. The opening slants downwardly to permit the carrier to be positioned over one's shoulder.

However, these devices do not offer a convenient and relatively inexpensive way to transport items of varying widths, nor do they suggest a way to keep such items organized either longer on a long term or short-term basis before or after they have been transported.

Therefore, it is desirable to have a simple, convenient, flexible, and easy-to-use device for carrying items having varied widths and organizing them after they have been transported.

SUMMARY

Methods, systems, and devices for transportation and storage of items such as clothing are disclosed. An item holding system may have an item holder and a base onto which the item holder is releasably attachable. The item holder may be a cross-piece or have a cross-piece extending generally horizontally across the item holder. The cross-piece may be sized to hold and balance a first plurality of items across a selected length of the cross-piece, and arranged to attach to or rest in a base. Alternatively, the item holder may be an item carrier having a cross-piece and a handle connected to the cross-piece, the handle having a hand-graspable section between a far end and a near end that is attached or attachable to the cross-piece, and the cross-piece, as before disclosed, sized to hold a one or more items thereacross and arranged to attach to or rest in a base.

The cross-piece may have one or more partitions disposed along its length, and the balancing may involve disposing the items along the selected length of the cross-piece in the one or more partitions, with at least one of the partitions having a first compartment sized to secure a first item within the partition.

In one embodiment, the cross-piece may have at least one hook for hanging a first item, with at least one partition disposed along the length of the cross-piece to form at least one compartment sized to hold at least one item. The cross-piece may have a plurality of partitions disposed along the length of the cross-piece alternatively, the cross-piece may have a single partition that extends end to end across the cross-piece.

In one embodiment, the partitions may have a first partition with a first divider with at least one portion of the first divider extending upwardly from a floor of the cross-piece a first selected height, and a second divider with at least one portion of the second divider having extending upwardly from the floor of the cross-piece a second selected height, and spaced the selected width on the cross-piece from the first divider, with the selected length and the selected width sized to contain or releasably secure a first item into the first partition between the first divider and the second divider.

In a further embodiment, the partitions are disposed on an upper surface of the cross-piece and the first divider (such as a rod or a panel) may be attached to the cross-piece and extend upwardly from the upper surface of the cross-piece; and the second divider (such as a rod or a panel) may be attached to the cross-piece and extend upwardly from the upper surface of the cross-piece and spaced the selected width on the cross-piece from the first divider, and with the first divider and the second divider forming a first compartment sized to hold a first item.

In another embodiment, the partitions may have at least two partitions, with a first partition having a first divider extending upwardly from the cross-piece and a second divider extending upwardly from the cross-piece, and a second partition having a third divider extending upwardly from the cross-piece and with the second divider and the third divider forming a second compartment sized to hold a second item. Further, the second divider may have tiers, with a first tier spaced a first distance from the first divider and a second tier spaced a second distance from the first divider, with the first distance being different from the second distance. In another embodiment, a partition may have a groove sized to snugly hold an item.

The partitions may extend outwardly on the cross-piece from the near end of the handle on both sides of the cross-piece. At least one of the partitions may have a first compartment sized to hold a first item. In further embodiments, the first compartment may have a first divider extending upwardly from the cross-piece, a second divider extending upwardly from the cross-piece and facing the first divider, and a distance between the first divider and the second divider that is slightly greater than a width of the first item. In still further embodiments, at least a portion of the first divider has a concave surface facing the second divider.

In other embodiments, the first divider may have a first surface that faces the second divider, and a first set of tiers may extend along the first surface, with the first set of tiers having a first tier and a second tier, the first tier disposed between the cross-piece and the second tier. The tiers may be so arranged that a first tier of the first divider has a first distance from the second divider; and a second tier of the first divider has a second distance from the second divider, with the first distance being different from the second distance, in another embodiment, with the first distance being less than the second distance.

In still further embodiments, a second surface of tiers may extend along the second surface of the second divider, with the tiers corresponding in position and height to tiers in the first set of tiers on the first surface of the first divider, and with the first distance being the distance between the first tier of the first surface and a corresponding first tier of the second surface, and the second distance being the distance between the second tier of the first surface and a corresponding second tier of the second surface.

In another embodiment, the cross-piece may have a first divider shaped like a tiered pyramid, with tiers that decrease in width across the cross-piece from a bottom tier at the cross-piece to a top tier; and the cross-piece may have a second divider positioned on the cross-piece next to the first divider and having tiers that correspond in position, width, and height to the tiers on the first divider. The first and second dividers may be arranged to have distance therebetween such that the distance increases between corresponding tier pairs in the first divider and the second divider defining spaces of increasing width as the tiers extend upwardly from the cross-piece.

In certain embodiments, at least one partition extends outwardly along the cross-piece from either side of the near end of the handle. In other embodiments, the hand-graspable section of the handle is disposable parallel to the cross-piece. In another embodiment, the hand-graspable section is disposable perpendicular to the cross-piece. In other embodiments, the handle is the handle is releasably attachable to the cross-piece. For example, the handle may be pivotable between a first position in which the hand-graspable section is disposable parallel to the cross-piece and a second position in which the hand-graspable section is disposable perpendicular to the cross-piece.

In still other embodiments, at least a portion of the hand-graspable section has a cross-piece-facing inside surface with an indentation sized to receive an article-carrying holder, such as a closet rod, a rod or stick of any other sort, a hook, a knob, or a portion of a hand. Further, the far end of the handle may extend downwardly from the hand-graspable section toward the cross-piece to receive and secure an item holder such as a hook.

In certain embodiments, the item carrier's handle and cross-piece are integral. In other embodiments, the handle is removable from the cross-piece.

As noted above, the item holding system may have an item holder and a base on or to which the item holder may be releasably positioned. In certain embodiments, the base is arranged to have an item holder releasably positioned thereon or, in further embodiments, releasably attached thereto, with the base sized and arranged to be releasably attachable to the cross-piece. The base may be a stand, a mount that is attachable to another article or wall, or a support bar. In further embodiments, the support bar may also be a component of a base. The support bar may be a generally horizontal arm, upon which the item holder may be supported, and the support bar may be sized and arranged for the cross-piece to be attachable thereto.

In certain embodiments, the support bar may be permanently affixed to the base; in other embodiments, it may be releasably attachable to the base so that it may be used as a support bar in another base. Further, the support bar may not be a component of the base. For example, the base may have a releasable clipping/locking system to attach a support bar thereto so that a support bar may be attached to the base.

In certain other embodiments, the base may be a stand having a leg with a near end and a far end, with one end of the cross-piece being releasably attachable directly or indirectly to the near end of the leg. The stand may have a leg with a far end and a near end that may be attachable to the support bar. In one embodiment, the leg is extensible to a plurality of lengths. In a further embodiment, the leg is arranged to telescope within itself to form the plurality of lengths. In one embodiment, an item-holding hook may be attachable to the base. In another embodiment, the stand may be a floor stand, with the far end of the leg disposable at or near a floor.

The stand may further have a footing attachable to the far end of the leg and having a set of contact points that, when the footing is disposed on a surface, provides the leg with a multi-point contact with the surface. In a further embodiment, the stand leg may be a first leg and the stand may have a second leg, and the stand may have a leg bridge attachable between the first leg and the second leg at or near the far ends of the first leg and the second leg.

In a further embodiment, the second leg may have a far end and a near end that is attachable to a position on the item holder that is spaced along the length of the item holder a selected distance from the first end of the item holder. In a still further embodiment, the second leg may be attachable to a second end of the support bar.

In one embodiment, more than one item holders may be directly or indirectly releasably attachable to each other. The item holders may be joinable end-to-end, with a first item holder having a near end and a far end, and with the second item holder having a near end, the far end of the first item holder joinable to the near end of the second item holder. In one embodiment, at least one of the item holders has a support bar associated therewith, and the releasable attachment is through the support bar. In one embodiment, the first item holder is of a different type than the second item holder; in another embodiment, the first and second item holders are of the same type.

In another embodiment, the base may have a support bar to which the item holder is releasably attachable, and the item storage system may have an item older/base connection system with a first connector element and a second connector element complementary in size and arrangement to the first connector element, with the first connector element arranged on a downwardly facing region of the item holder (in further embodiments, the first connector element is arranged on a downwardly facing region of the cross-piece) and with the second connector that is complementary in configuration and position on an upwardly facing region of a support bar on the base.

The first connector element and the second connector element may be arranged to fit snugly together in a locking but releasable relationship. In a further embodiment, the first connector element has a recess or a cavity in the downwardly facing region of the item holder, and the second connector element has projection such as a a bar extending from the upwardly facing region of the support bar and sized to fit snugly in the recess or cavity.

In other embodiments, a base may be a mount that is attachable to another article, such as a movable or fixed item or a wall. The mount may have a support bar, which may be a generally horizontal arm, that is sized and arranged for a cross-piece to be directly or indirectly attachable thereto, and a mount arm that may be disposable generally perpendicular to the support bar and attachable to the article. The mount arm may be permanently fixed or temporarily fixable to the article or a portion of the article no matter the orientation of the support bar to the element of the article to which the support bar is attached. The base may also have a locking element to secure the support bar into the desired orientation relative to the mount arm to maintain a preferred orientation of the cross-piece. Further, in certain embodiments, bases may have a mount arm with a releasable clipping/locking system to attach a support bar thereto so that a support bar may be attached to the base.

A method for holding, carrying, and storing items such as clothing is also disclosed, in which a plurality of items may be held and balanced across a selected length of a cross-piece extending generally horizontally across an item holder, with the cross-piece having one or more partitions disposed along the selected cross-piece length. The items may be held and balanced by being disposed in one or more partitions along the selected length of the cross-piece.

Among the partitions may be a first partition having a first divider with at least one portion having a first selected height and extending upwardly from an upper surface of the cross-piece. The first divider may have a second divider with at least one portion having a second selected height and extending upwardly from the upper surface a selected partition width apart on the upper surface from the first divider. The items may be disposed in one or more partitions by releasably securing a first item into the first partition between the first divider and the second divider.

In further embodiments, the cross-piece may be releasably attached to a support bar on a base sized and arranged to support the item holder; in other embodiments, one or more partitions may be sized to snugly contain at least one of the or multiple items therewithin, and multiple items may be contained by snugly securing the items in one or more of the partitions.

In further embodiments, the item holder may be carried with a handle having a far end, a near end that is releasably attachable to the cross-piece, and a hand-graspable section between the far end and the near end of the handle. In other embodiments, the item holder may be positioned on a base by releasably attaching a support bar on the base to the cross-piece.

The clothing storage and carriers described herein are very adaptable and may be used to transport clean laundry from the laundry facilities, and especially to store the clean laundry organized and unrumpled for short or long periods of time.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF THE DRAWINGS

FIGS. 1A-1-1A-4 are views of an exemplary item holder 100*a* configured as an item carrier 101*a*, with:

- FIG. 1A-1 being a side view of the assembled item carrier 101*a* having a connector 140*a* for connecting a handle 110 to a cross-piece 120 in a fixed connection 142*a*, with a hand-graspable section 112 of the handle 110 disposed parallel to the cross-piece 120,
- FIG. 1A-2A being a perspective view of the handle 110 shown in FIG. 1A-1,
- FIG. 1A-2B being an exploded view of the item carrier 101*a* showing the aperture 115,
- FIG. 1A-3 being a perspective view of the connector 140*a* shown in FIG. 1A-1, and
- FIG. 1A-4 being a side view of the cross-piece 120 arranged to receive the connector 140*a* shown in FIG. 1A-3;

FIGS. 1B-1-1B-4 are views of an item holder 100*b* configured as an alternative exemplary item carrier 101*b*, with:

- FIG. 1B-1 being a perspective view of the item carrier 101*b* having a connector 140*b* for connecting a handle 110 to a cross-piece 120 in a fixed connection 142*b*, with a hand-graspable section 112 of the handle 110 disposed perpendicular to the cross-piece 120,
- FIG. 1B-2 being a perspective view of the handle 110 shown in FIG. 1B-1,
- FIG. 1B-3 being a perspective view of the connector 140*b* shown in FIG. 1B-1, and
- FIG. 1B-4 being a side view of the cross-piece 120 shown in FIG. 1B-1, also used in item carrier 101*a* shown in FIG. 1A-1;

FIG. 2B-1-2B-4B are views of an item carrier 201*b* with an alternative pivotable connection 242*b*, with:

- FIG. 2B-1 being an exploded view of the item carrier 201*b,*
- FIGS. 2B-2A and 2B-2B being a perspective view and a top view, respectively, of the flexible inset 222*b* shown in FIG. 2B-1,
- FIGS. 2B-3A and 2B-3B being a perspective view and a top view, respectively, of the lower washer 226*b* shown in FIG. 2B-1, and
- FIGS. 2B-4A and 2B-4B being cross-sectional views of the connector 240*b* shown in FIG. 2B-1 when the item carrier 201*b* is assembled;

FIGS. 2C-1-2C-5B are views of an item carrier 201*c* with another alternative pivotable connection 242*c*, with:

- FIG. 2C-1 being a side view of an assembled item carrier 201*c* having a pivotable connector 240*c* between a handle 210*c* and a cross-piece 220*c,*
- FIG. 2C-2 being a side view of the handle 210*c* of an unassembled item carrier 201*c,*
- FIGS. 2C-3A-2C-3C being a side view, a first perspective view, and a second perspective view, respectively, of the connection member 231*c* of the connector 240*c,*
- FIGS. 2C-4A-2C-4B being a first perspective view and a second perspective view, respectively, of a cross-piece 220*c* of an unassembled item carrier 201*c,*

FIG. 2C-5A being a cross sectional view of an assembled item carrier 201*c* showing the shaped recess 221*c*, and FIGS. 2C-5B being a cross sectional detail view of the shaped recess 221*c* of FIG. 2C-5A;

FIGS. 2C-6A-2C-6C are a side view, a first perspective view, and a second perspective view, respectively, of a model 251*c* of the material that was subtracted from the cross-piece during manufacturing of the shaped recess 221*c;*

FIGS. 2D-1-2D-5B are views of an item carrier 201*d* with another alternative pivotable connection 242*d*, with:

FIG. 2D-1 being a perspective view of an assembled item carrier 201*d*, illustrating the bottom of the cross-piece 220*d,*

FIGS. 2D-2A and 2D-2B being a perspective view and top view, respectively, of the cross-piece 220*d* with an inset 222*d* fit into a recess 221*d* of the cross-piece, FIGS. 2D-3A and 2D-3B being a first perspective view and second perspective view, respectively, of the inset 222*d,*

FIGS. 2D-4A-2D-4C being a side view, a perspective view, and a bottom view, respectively, of the connector 240*d,*

FIG. 2D-5A being a cross-sectional view of an assembled item carrier 201*d*; and FIG. 2D-5B being a detail view of the connection member 231*d* shown in the cross-sectional view FIG. 2D-5A, with the connection member 231*d* fit into the recess 221*d;*

FIGS. 3A-3E are views of alternative embodiments of connections between an item carrier handle and an item carrier cross-piece, with:

FIG. 3A showing an exploded, perspective view of a handle-to-cross-piece cross connection 342*a,*

FIG. 3B showing an exploded, perspective view of a handle-to-cross-piece star connection 342*b,*

FIG. 3C showing an exploded, perspective view of a handle-to-cross-piece knurl connection 342*c,*

FIG. 3D-1 showing an exploded, perspective view of a handle-to-cross-piece cross friction connection 342*d,*

FIGS. 3D-2A-3D-2C showing more detail of an aperture 315*d* in a perspective view, a bottom view, and a top view, respectively, of the handle-to-cross-piece cross friction connection 342*d,*

FIG. 3D-3A and FIG. 3D-3B showing more detail of the sprocket 328*d* shown in FIG. 3D-1, with FIG. 3D-3A showing a first perspective view and FIG. 3D-3B showing a second perspective view of the sprocket 328*d*, and FIG. 3D-4 showing a cross-sectional view of the center of the aperture in the near end 316*d* of the handle 310*d* in the item carrier 301*d* showing the wedge-shaped recesses into which the sprocket 328*d* may be inserted to create a friction fit of the sprocket within the aperture, and FIG. 3E showing a handle-to-cross-piece snap ring connection 342*e;*

FIGS. 4A-4F are views of embodiments of partitions and components thereof on exemplary cross-pieces, with FIG. 4A showing a perspective view of a multi-partition cross-piece 420*a* with planar panels 412*a* extending from the upper surface 422*a* of the crossspiece, FIG. 4B showing a perspective view of a multi-partition cross-piece 420*b* with rods 414*b* extending from the upper surface 422*b* of the crossspiece, FIG. 4C showing a side view of a divider 412*c* with a planar surface 414*c* on a first side of the divider and a concavity 416*c* on a second side of the divider, FIG. 4D showing a side view of a divider 412*d* with a concavity 416*d* on both sides of the divider, FIG. 4E showing a side view of a divider 412*e* with a planar surface 414*e* on a first side of the divider and a tiered surface 416*e* on the second side of the divider, and FIG. 4F showing a side view of a divider 412*f* with a tiered surface 416*f* on both sides of the divider;

FIGS. 4G-4K are views of alternative embodiments of upper surfaces of exemplary cross-pieces, with:

FIG. 4G showing a side view of a grooved upper surface 422*g* of an exemplary cross-piece 420*g,*

FIG. 4H showing a side view of a scalloped upper surface 422*h* of an exemplary cross-piece 420*h,*

FIG. 4I showing a side view of a sinusoidal upper surface 422*i* of an exemplary cross-piece 420*i,*

FIG. 4J showing a side view of a zigzag upper surface 422*j* of an exemplary cross-piece 420*j*, and FIG. 4K showing a perspective view of an upper surface 422*k* of an exemplary cross-piece 420*k* having a single partition that extends end to end across the cross-piece 420*k;*

FIGS. 5A-5J are views of alternative embodiments of uses for an item carrier 501, with:

FIG. 5A showing a side view of the item carrier 501 hanging from a hook 25*a,*

FIG. 5B showing a side view of the item carrier 501 hanging from a closet rod 25*b,*

FIG. 5C-1 showing a side view of the item carrier 501 hanging from a hanger bar 25*c*, which may be on the interior of a vehicle, with its handle 510 pointing toward the outside of the vehicle, FIG. 5C-2 showing a side view of the item carrier 501 hanging from the hanger bar 25*c*, with the handle 510 pointing to the interior of the vehicle, FIG. 5D showing a perspective view of an item carrier 501 hanging from a handle 25*d* of a laundry basket 20*d,*

FIG. 5E showing a perspective view of an item carrier 501 slipped over a loop 25*e* on the top edge of a hamper 20*e,*

FIG. 5F showing a perspective view of an item carrier 501 hanging from a horizontal rib 25*f* of a rolling laundry basket 20*f,*

FIG. 5G showing a perspective view of an item carrier 501 hanging from a horizontal support rod 25*g* of a rolling laundry cart 20*g,*

FIG. 5H showing a perspective view of an item carrier 501 hanging from a loop 25*h* on the rear of a backpack 20*h,*

FIG. 5I showing a perspective view of an item carrier 501 hanging from the edge of a shelf 25*i* in a shelving unit 20*i*, and FIG. 5J showing a perspective view of an item carrier 501 hanging from a horizontal bar 25*j* on the frame of a walker 20*j;*

FIGS. 6A-6F are views of embodiments of components of exemplary item holding systems of the current invention, with:

FIG. 6A showing a side view of a stand 650*a* to which item holders may be releasably attached, FIG. 6B showing a side view of a stand 650*b* with an alternative footing, FIG. 6C showing a perspective view of a stand 650*c* with two legs, FIG. 6D showing a perspective view of a stand 650*d* with four legs and formed from two stands 650*c*, and further with a support bridge releasably attached end-to-end between the two cross-pieces of the stands 650*c*, and FIGS. 6E and 6F showing perspective views of hooks 652, 654 for attachment to legs of stands in exemplary item holding systems;

FIGS. 6G-6K are perspective views of item holding systems having mounts that may operate as bases that may be attachable to another item to which an item carrier may be releasably attached, with:

FIG. 6G showing an item holding system having a mount 650*g* which may be fitted onto a leg 37*g* or a frame bar 38*g* of a walker 30*g*, FIG. 6H showing an item holding system having a mount 650*h* which may be fitted to a vertical leg 37*h* or a shelf 38 of a shelving unit 30*h*;

FIGS. 6I and 6J showing item holding systems having vertical mounts that may be attached to generally vertical surfaces such as walls, with the mount 650*i* of FIG. 6I being collapsible and the mount 650*j* of FIG. 6J being fixed, and FIG. 6K showing an item holding system 650*k* having a frame 680*k* for hanging an item holder to a ceiling or under a shelf, for example one on a wall or in a closet or shelving unit;

FIGS. 7A-1-7D-2 are views of support bar-to-item holder connections, with:

FIGS. 7A-1-7A-3 being views of a tongue and groove connection system, with FIG. 7A-1 being a perspective view of the components of an unassembled joinery system 700*a*, and FIGS. 7A-2, 7A-3 being a side view and a cross-sectional view, respectively, of an assembled joinery system 700*a*, FIG. 7B being a perspective view of an unassembled cross-piece/support bar stud/socket connection system 700*b*, FIG. 7C being a perspective view of an unassembled cross-piece/support bar cross-shaped stud/socket connection system 700*c*, FIG. 7D-1 being a side view of an unassembled cross-piece/support bar clip connection system 700*d*, and FIG. 7D-2 being a detail view of the panel 731*d* on either side of the support bar 730*d*;

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Item Holders

Figures 1, 1A:
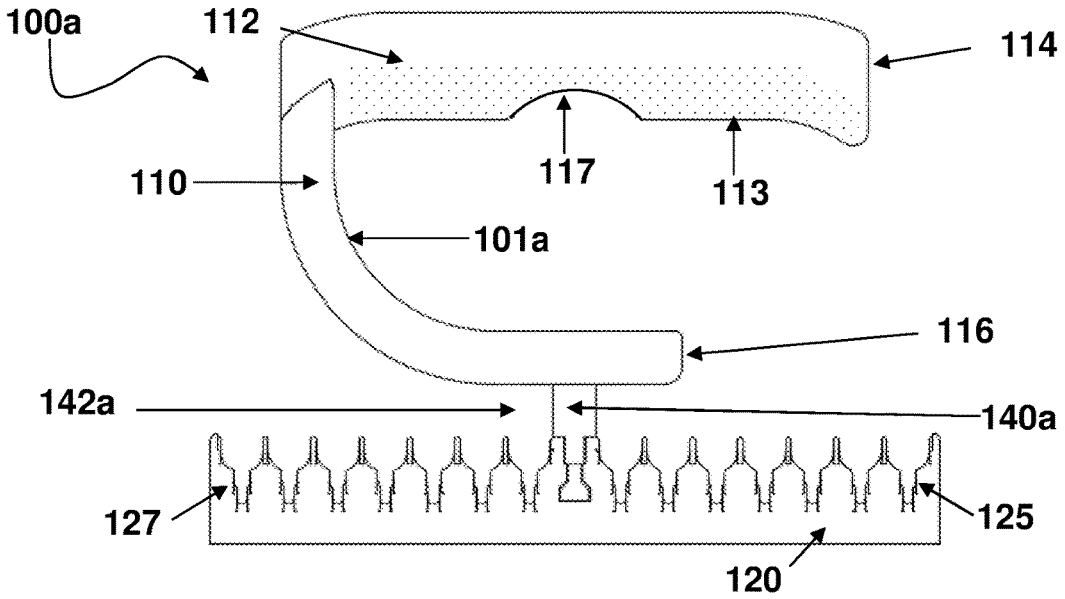

An item holder 100 according to the present invention will now be described in detail with reference to FIGS. 1A-1 to 1A-4 of the accompanying drawings. The item holder 100 shown in FIG. 1A-1 is an item carrier 101*a*, which may be used for transportation of items by hand and for long-to-short-term storage of items such as clothing. The hand-held clothing carrier 101*a* may be used to keep hanger-held clothes, such as tee shirts, dress shirts, sports shirts, pants and skirts, hung up, organized and relatively unwrinkled as soon as they come out of the washer or dryer in the laundry room or at the laundromat. Referring to FIGS. 1A-1A and 1A-2B, the item carrier 101*a* may have a generally straight and horizontal cross-piece 120 having a length from a near cross-piece end 124 to a far cross-piece end 126 and sized to hold and carry a plurality of items across the length of the cross-piece 120 from the near cross-piece end 124 to the far cross-piece end 126. The cross-piece 120 may be sized to hold and balance a first plurality of items across the length of the cross-piece from the near cross-piece end 124 to the far cross-piece end 126 in one or more partitions disposed along the cross-piece length, with the balancing further comprising disposing the items along the cross-piece length in the one or more partitions. The cross-piece may have one divider 125 projecting extending upwardly from the floor of the cross-piece 120 at the near cross-piece end 124, and another divider 127 extending upwardly from the floor of the cross-piece at the far cross-piece end 126.

Figures 1, 1A, 2, 2A:
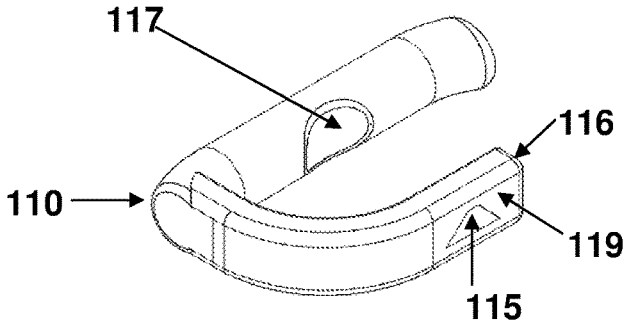
Figures 1, 1A, 2, 2B:
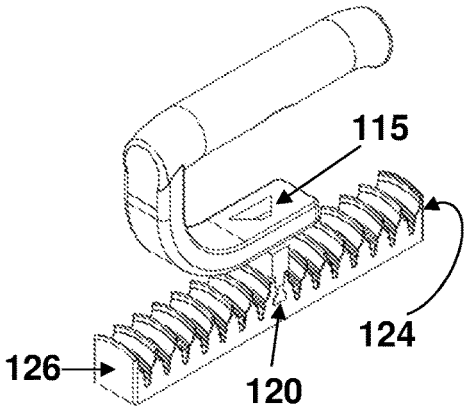
Figures 1, 1A, 2, 3:
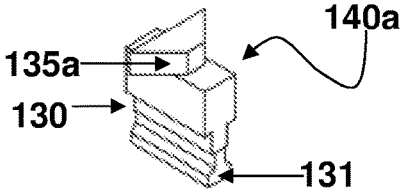
Figures 1, 1A, 2, 3, 4:
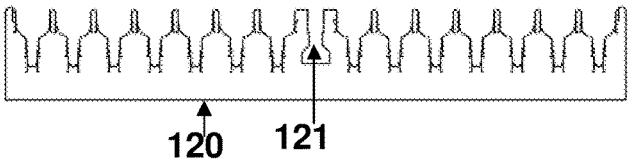
Figures 1, 1B:
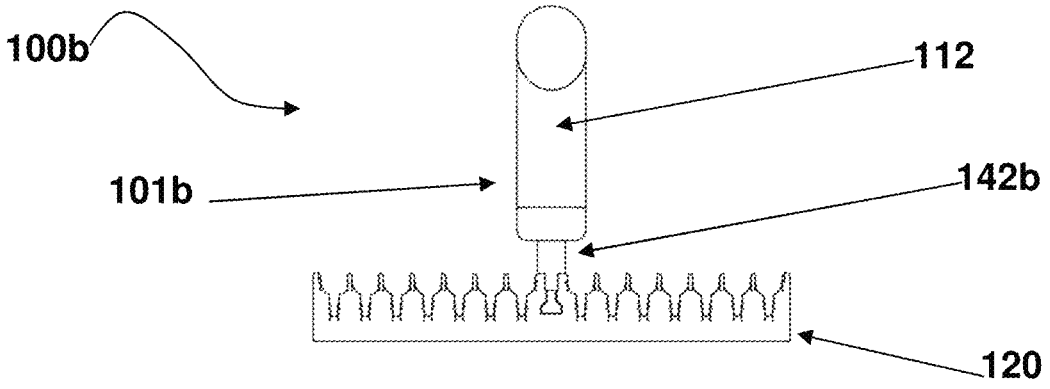
Figures 1, 1B, 2:
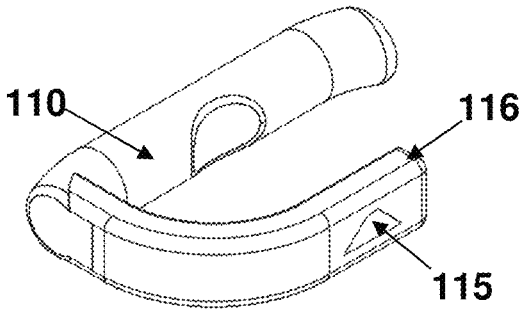
Figures 1, 1B, 2, 3:
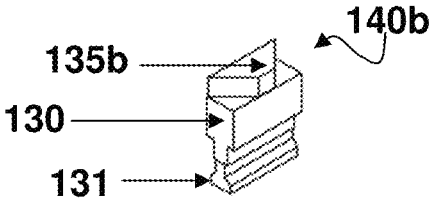
Figures 1, 1B, 2, 3, 4:
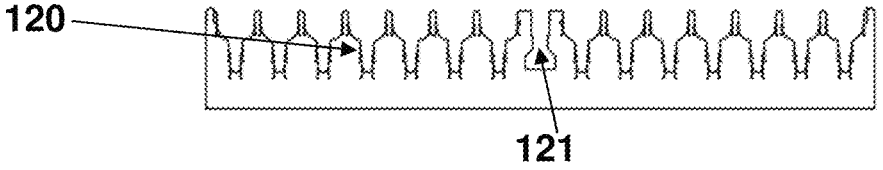
Figure 2A:
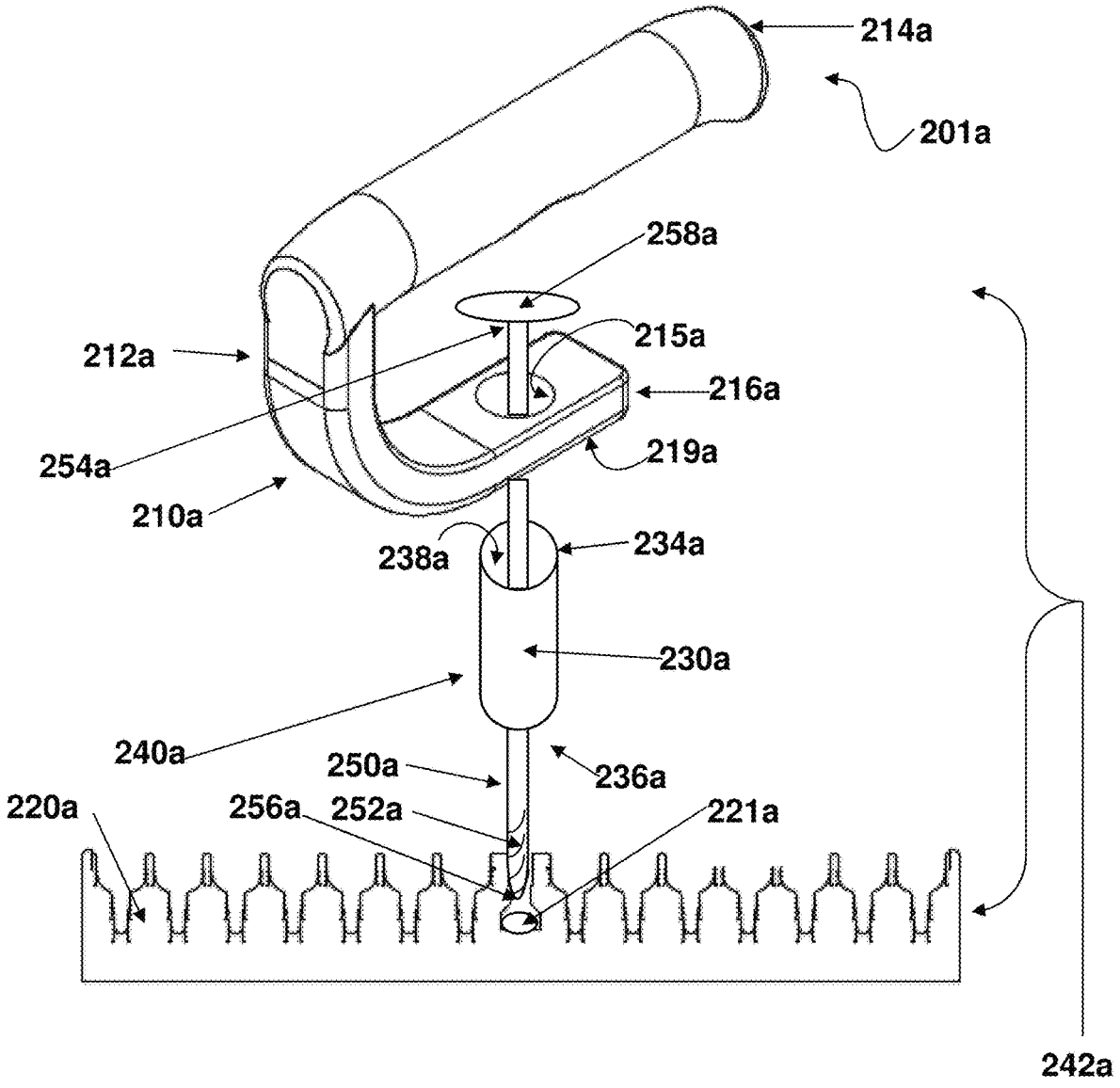
FIG. 2A is an exploded, perspective view of an item carrier 201*a* with a pivotable connection 242*a* between a handle 210*a* and a cross-piece 220*a*, the pivotable connection 242*a* arranged for modifying the orientation of the hand-graspable section 212*a* of the handle 210*a* relative to the cross-piece 220*a;*
Figures 1, 2B:
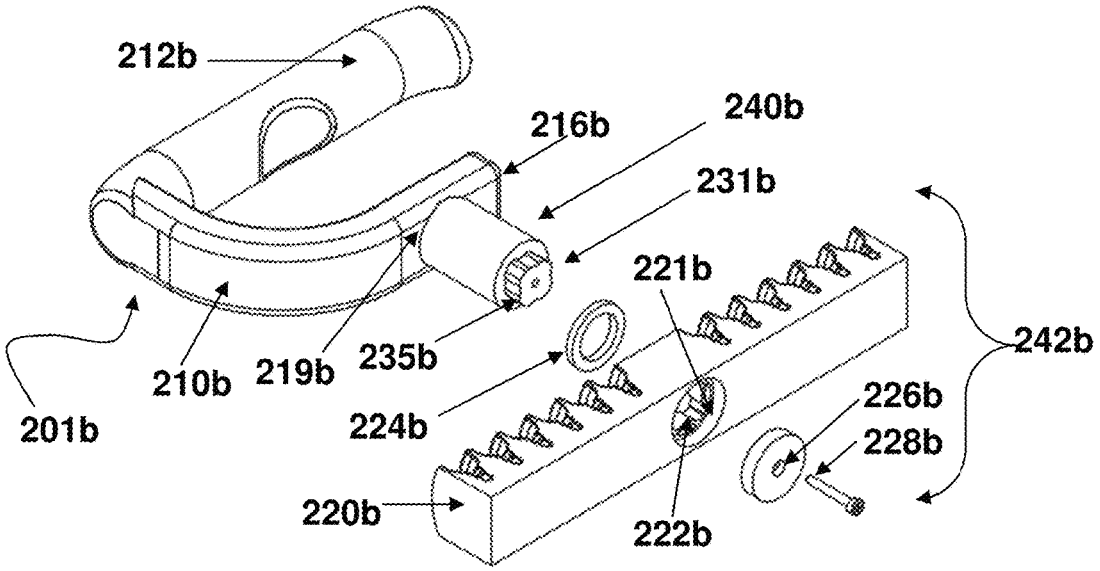
Figures 2A, 2B:
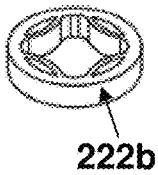
Figure 2B:
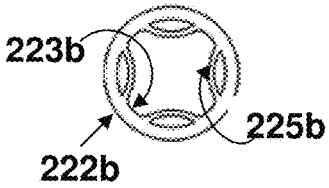
Figures 2, 2B, 3, 3A:
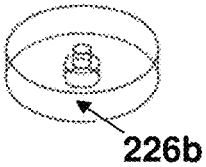
Figures 2, 2B, 3, 3B:
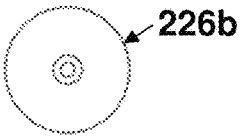
Figures 2, 2B, 3, 4, 4A:
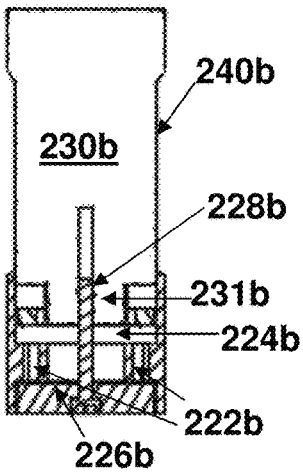
Figures 2, 2B, 3, 4, 4B:
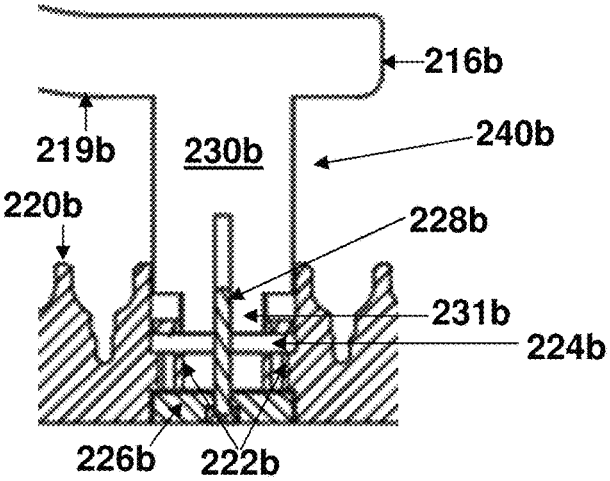

The cross-piece may also have a handle 110 and a post 130 that extends from the handle 110 to the cross-piece 120. The cross-section of the post, which may have any convenient shape, such as a circle, oval, or rectangle, may be left to the choice of the designer. The handle 110 may have a generally horizontal far end 114 that is free and a near end 116 that is connected to the post 130, which extends perpendicularly between the handle and the cross-piece 120. The handle may be designed according to ergonomic principles, with shape, materials, thickness, strength, replaceability, and cleanability features selected to make the handle as comfortable and convenient as possible to use. For example, the handle 110 may have a near end, a far end, and a hand-graspable section 112 that, as shown in many figures, including FIGS. 1A-1, 1A-2A, 1A-2B, 1B-2, 2A, 2B-1, 2C-1, 2D-1, 2A, 3B, 3C, 3D-1, 3E, and 5A may be generally cylindrical, straight, and elongated with softened or no edges, grooves, seams or corners. The hand-graspable section 112 may have an indentation 117 on its bottom surface 113 sized to receive a hand (not shown), a hook (as shown in FIG. 5A) on a wall, or a conventional closet rod (not shown).

In certain embodiments, the indentation may have gentle finger grooving (not shown) to help the hand stay in place in the indentation, or to stop the handle from rolling off a hook or rod. In other embodiments, slippage may be further reduced and the grip improved by ensuring sufficient friction between the hand and handle, especially when the cross-piece is loaded with items. In certain embodiments, friction is increased by supplying the bottom surface 113 with an anti-slip surface, which may be applied to the indentation alone, the entire bottom surface 113, or even on the entire hand-graspable section.

In certain embodiments, the anti-slip surface may be lightly knurled, or the indentation or hand-graspable section may be formed of or coated with a compressible material, for example, a textured rubber to promote a good grip and reduce the force used to hold the carrier in hand. Another suitable material is a low density polyethylene (LDPE), which may provide a soft finish that is comfortable to the touch. In other embodiments, thermoplastic elastomer (TPE) may be used to provide a soft-touch grip. In other embodiments, a "sticky" material may be used to provide a graspable coating.

The cross-piece may have a fixed or pivotable connection to the handle, at the choice of the designer. FIG. 1A-1 shows the hand-graspable section 112 of the handle 110 disposed parallel to the cross-piece 120. As disclosed below, FIG. 1B-1 shows an item holder 100 as an item carrier 101*b* with the hand-graspable section 112 of the handle 110 in an orientation disposed perpendicular to the cross-piece 120. Other embodiments of item carriers with the cross-piece pivotable relative to the handle are disclosed below, but any conventional pivoting system is also contemplated herein, the choice of which is left to the designer.

Handle-to-Cross-Piece Connections

In certain embodiments (not shown), the handle and the cross-piece of the item carrier may be integral. In other embodiments, for example in FIGS. 1A-1 to 1A-4, the handle may have a connector 140*a* to provide fixed connection 142*a* between the handle and the cross-piece. In FIGS. 1A-1 to 1A-4, the connecter 140*a* may have a post 130 positioned between a shaped connection member 131 fixable to the cross-piece 120 and a dovetail connection member 135*a* fixable to the handle 110.

Figure 1C:
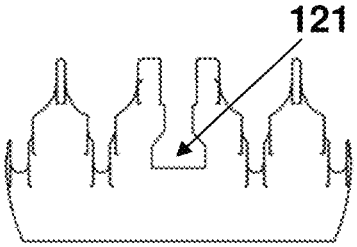
FIG. 1C is a more detailed side view of the cross-piece recess 121 in the cross-piece 120 shown in FIGS. 1A-4 and 1B-4.
Figure 1D:
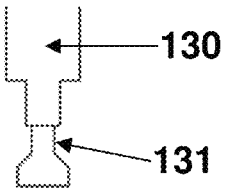
FIG. 1D is a more detailed side view of the complementary connection member 131 disposed below the post 130 shown in FIGS. 1A-3 and 1B-3.

As shown in more detail in FIGS. 1C and 1*n* even further detail in FIG. 1D, the shaped connection member 131 is shaped to be complementary to a recess 121 in the cross-piece 120, the recess 121 having walls that are shaped to be complementary to the exterior shape of the connection member 131, so that the connection member 131 may be adhered into, clipped into, or otherwise be secured into the recess 121, thus fixing the post 130 to the cross-piece 120. The fixing of the connection member 131 to the cross-piece 120 may be releasable so that the handle 110 may be detached from or secured to the cross-piece at the user's convenience.

The dovetail connection member 135*a*, also shown in detail in FIG. 1A-3, is shaped to be complementary to a complementary recess 115 (which may also be an aperture) in the bottom surface 119 of the near end 116 of the handle 110 (and, as shown in FIG. 1A-2B, which may also be an aperture through the handle 110. As shown in FIGS. 1A-2A, 1A-2B, the recess 115 is shaped to receive the dovetail member 135*a*. The dovetail connection member 135*a* may be fitted into and then adhered into or otherwise secured into the recess 115, thus forming a dove tail connection between the post 130 and the handle 110.

In FIG. 1A-3, the dovetail member 135*a* may be disposed on the connector 140*a* to fit into the dovetail recess 115 so that the hand-graspable section 112 of the handle 110 is oriented parallel to the cross-piece 120. It will be seen, with reference to FIGS. 1B-1-1B-3, the item holder 100 may be used in another illustrative but not necessarily preferred embodiment of an item carrier 101*b* in which an alternative fixed connection 142*b* may be provided so that the hand-graspable section 112 of the handle 110 is oriented perpendicular to the cross-piece 120.

In the illustrative but not necessarily preferred embodiment of the item carrier 101*b* shown in FIGS. 1B-1-1B-3, the item carrier 101*b* may be formed of the same handle 110 and cross-piece 120 used in the item carrier 101*a* shown in FIGS. 1A-1; alternatively, any other suitable hand and cross-piece may be used. The carrier 101*b* may also have a fixed connection 142*b* in which the hand-graspable section 112 of the handle 110 may be oriented perpendicular to the cross-piece 120. The fixed connection 142*b* may be formed by disposing a connector 140*b* between the near end 116 at the top end of the connector 140*b* and the top surface of the cross piece 120.

As shown in more detail in FIG. 1B-3, the post 130, used in the connector 140*a* shown in FIGS. 1A-3, may also be used in the connector 140*b*. Alternatively, the shape of the post may have any convenient shape. At its upper end, the post may be connected to or integral with a dovetail member 135*b* that may be fitted into and then adhered into or otherwise secured into the dovetail recess 115 of the handle 110. The post 130 at its lower end may also be connected to or integral with the shaped connection member 131 used in the connector 140*a*, or that may be shaped as preferred by the designer to secure the connector 140*b* to the cross-piece 120.

In the embodiment shown in FIG. 1B-3, the connection member 131 may be arranged to be complementary to the recess 121 in the cross-piece 120. As in the item carrier 101*a*, the recess 121 may have walls that are shaped to be complementary to the exterior shape of the connection member 131, so that the connection member 131 may be adhered into, clipped into, or otherwise be secured into the recess 121, thus connecting the post 130 into the cross-piece 120.

A comparison of the connector 140*a* in FIG. 1A-3 and the connector 140*b* of FIG. 1B-3 shows that, in the connector 140*a*, the orientation of the dovetail member 135*a* is offset relative to the post 130 by 90 degrees from the orientation of the dovetail member 135*b* relative to the post 130 in the connector 140*b*, while the recess 115 into which the dovetail member 135*a* fits in the item carrier 101*a* has the same shape and orientation as the recess 115 into which the dovetail member 135*b* fits in the item carrier 101*b*. The perpendicular offset of the dovetail member 135*b* causes the handle 110 to be offset perpendicularly to the cross-piece 120 in the item carrier 101*b*.

In alternative embodiments, some examples of which are disclosed below, the item carrier may be provided with a pivotable connection so that the hand-graspable section 112 of the handle 110 may be moved into any desired orientation relative to the cross-piece 120. For example, the dovetail member 135*b* may be rotatably fixed to the post to allow for rotation of the cross-piece around the length-wise axis of the post 130, so that the dovetail member, while secured between the post and the handle, may be rotated relative to the post to allow the user to position the cross-piece relative to the handle at an angle that is convenient to the user.

In alternative embodiments, the connection member may be provided with a pivotable connection so that the post may be moved into any desired orientation relative to the cross-piece. For example, the connection member may be arranged to be rotatably fixed to the post to allow for rotation of the cross-piece around the length-wise axis of the post 130, so that, when the connection member is secured into the recess, the cross-piece may be rotated relative to the post to any convenient angle.

In another example, the connection member may be provided with a rounded exterior surface which is symmetric around the length-wise axis of the post 130 so that, when the connection member is secured into the recess 121, the connection member may be rotatable within the recess to allow the user to position the cross-piece relative to the handle at any convenient angle.

In another illustrative but not necessarily preferred embodiment, an item carrier 201*a* shown in FIG. 2A may have a pivotable connection 240*a* to allow the handle 210*a* to operate as a swing hook for modifying the orientation of the handle 210*a* relative to the cross-piece 220*a*. For example, the connection 240*a* may be arranged to orient the handle 210*a* parallel to the cross-piece 220*a* to start and then to orient the handle 210*a* perpendicular to the cross-piece, or to orient the handle 210*a* relative to the cross-piece at any angle therebetween.

In the item carrier 201*a* in FIG. 2A, a pivotable connector 240*a* may be disposed between a handle 210*a* and a cross-piece 220*a* to provide the item carrier with a pivotable connection 242*a* so that the item carrier 201*a* may be used in different angular configurations. For example, the handle may be perpendicular to the cross-piece when the item carrier hung in an automobile, and then adjusted to be parallel to the cross-piece when the item carrier is hung in a closet. In addition, a user may pivot the handle into whatever orientation is comfortable when carrying the loaded item carrier in front of his body or slung over his shoulder.

As shown in FIG. 2A, the handle 210*a* may have a hand-graspable section 212*a* with a far end 214*a* that is free and a near end 216*a* that is contiguous with or integral to a top edge 234*a* of a hollow tube 230*a*, which extends downward from the near end 216*a* to a bottom edge 236*a* of the tube resting on or attached to the cross-piece. The hand-graspable section 212*a* may have an aperture 215*a* extending from the bottom surface 219*a* of the section 212*a* to the upper surface of the section 212*a* on or near its near end 216*a*. The aperture 215*a* may be sized and positioned to engage the top edge 234*a* of the hollow tube 230*a* and through which access may be had to the hollow 238*a* of the tube 230*a*.

A pin 250*a* may be sized with a diameter sufficient to fit inside the tube 230*a*. In certain embodiments, the pin diameter may be sized to allow the tube 230*a* to rotate around the pin 250*a*. The pin may have an attachment mechanism such as a male screw thread 252*a* at the pin bottom end 256*a*, and a nailhead 258*a* at its top end 254*a*. The nailhead 258*a* may be sized to extend over the top edge of the aperture 215*a* of the handle 210*a* and thus to contain the pin within the tube 230*a* and the tube against the hand-graspable section 212*a* when the pin 250*a* is inserted bottom end first through the aperture 215*a* and tube 230*a* and into the cross-piece 220*a*.

The pin may be provided with a length sized to allow the pin to extend from the top edge of the aperture 215*a* of the handle 210*a* to the tube bottom edge 236*a* of the tube 230*a*, with the male screw thread 252*a* exposed beyond the tube bottom edge 236*a*, when the pin 250*a* is inserted through the handle 210*a* and into the hollow of the tube 230*a*. The male screw thread 252*a* may then be used to secure the pin 250*a* to the cross-piece 220*a* through an aperture 221*a* in the upper surface of the cross-piece 220*a*, with sufficient leeway to allow the handle to pivot relative to the cross-piece and with sufficient tautness to cause, by operation of friction, the item carrier 201*a* to remain in the orientation desired by the user. Alternatively, the tube 230*a* may be fixed to the handle 210*a* but held lightly against the cross-piece 220*a* so that the tube may rotate around the pin 250*a* and thus move the handle relative to the cross-piece.

Another illustrative but not necessarily preferred embodiment of an item holder is an item carrier 201*b* shown in FIGS. 2B-1-2B-4B, which has a connector 240*b* providing a pivotable connection 242*b* in which the item carrier 201*b* may be moved through a selected number of positions of the handle relative to the cross-piece. The connector 240*b* may have a post 230*b* arranged to be joined at its upper end to the bottom surface 219*b* of the near end 216*b* of the handle 210*b*. The connector 240*b* may have a cam 231*b* serving as a connection member, the cam integrated into or fixed to a lower end of the post 230*b*, with the cam arranged to fit snugly into a flexible inset 222*b* integrated into or fixed to a recess 221*b* in the cross-piece 220*b*.

The cam 231*b* may be generally circular in cross-section with a bottom surface and a set of cam teeth 235*b* extending outwardly around the cam's exterior circumference. As shown in FIGS. 2B-2A and 2B-2B, the flexible inset 222*b* may be formed of a generally circular ring with a circumference sized to fit snugly into the recess 221*b* and an inner circumference 223*b* that has a series of inner arches 225*b* that are attached at each of their ends to the inner circumference 223*b* and that are spaced around the inner circumference. The inset 222*b* has the same number of arches 225*b* (in this embodiment, four arches) as the number of teeth in the cam 231*b* (in this embodiment, four cam teeth), and the arches 225*b* are sized to squeeze between the cam teeth 235*c* when the cam is fitted into the inset, thus holding the cam firmly into the inset.

An upper washer 224*b* shown in FIG. 2B-1 may be sized to fit into the recess 221*b* below the cam/inset combination and provide the combination with a smooth surface upon which to rest, and a lower washer 226*b*, shown in FIG. 2B-1 and in more detail in 2B-3A and 2B-3B, may be sized to fit into the recess 221*b* below the upper washer. As shown in FIGS. 2B-4A and 2B-4B, the lower washer may have an aperture into which a pin or screw 228*b* may be fit and extend through the center of the upper washer and the inset, and driven into the bottom surface of the cam to secure the connector to the cross-piece.

In operation, as the handle is turned relative to the cross-piece, the upper washer 224*b* provides the connector 240*b* with a smooth surface upon which to rotate. The rotation exerts pressure on the bendable plastic arches, which flex to allow them to exit the recesses between the cam teeth into which they are squeezed and to pass with friction over the cam teeth and settle into the recesses adjacent to the recesses of their original positions (in this embodiment, in which the cam has four cam teeth, the pivot displaces the position of the cam by 90 degrees), where through operation of friction the squeezed arches hold the handle 210*b* into its new angular position relative to the cross-piece.

Figures 1, 2C:
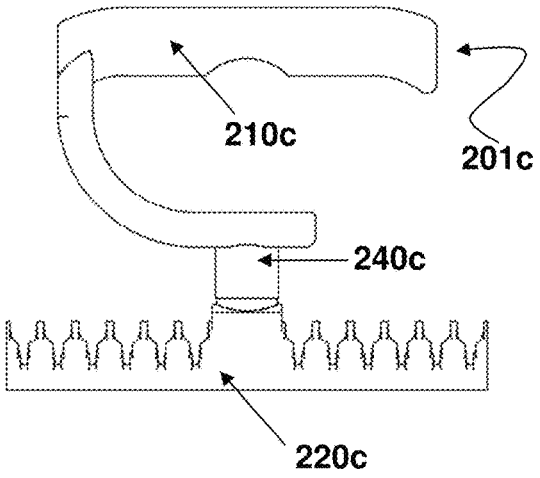
Figures 2, 2C:
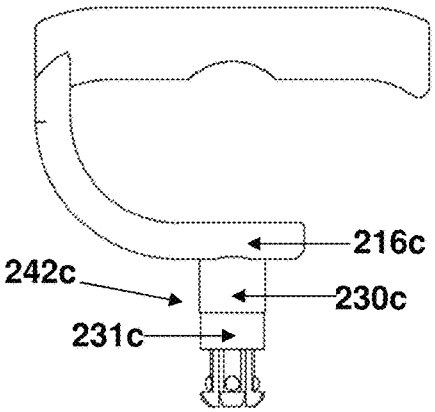
Figures 2, 2C, 3, 3A:
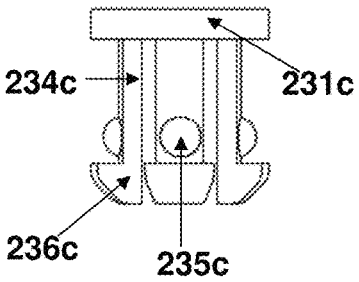
Figures 2, 2C, 3, 3B:
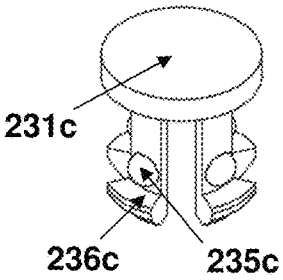
Figures 2, 2C, 3, 3C:
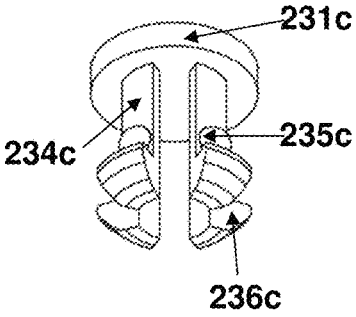
Figures 2, 2C, 3, 4, 4A:
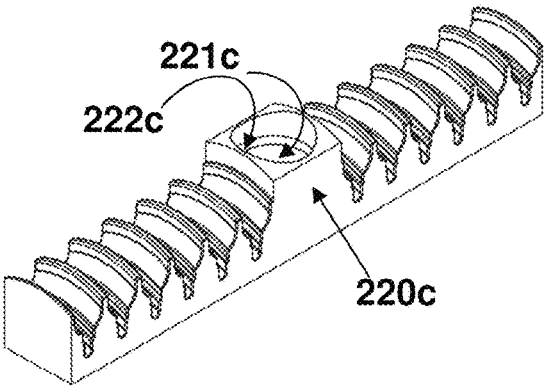
Figures 2, 2C, 3, 4, 4B:
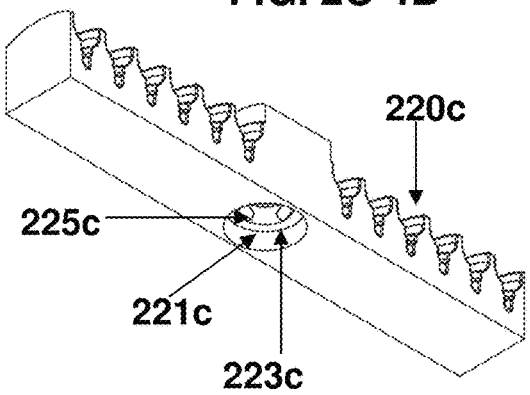
Figures 2, 2C, 3, 4, 5, 5A:
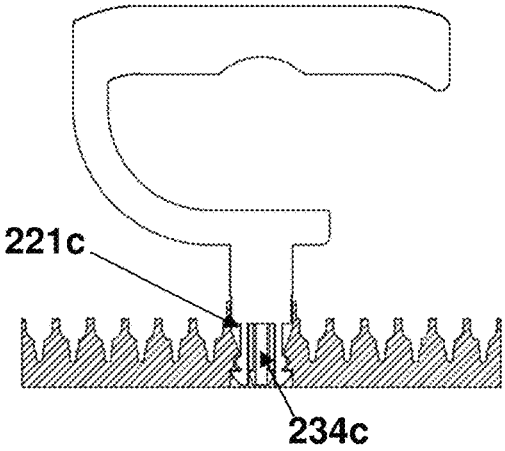
Figures 2, 2C, 3, 4, 5, 5B:
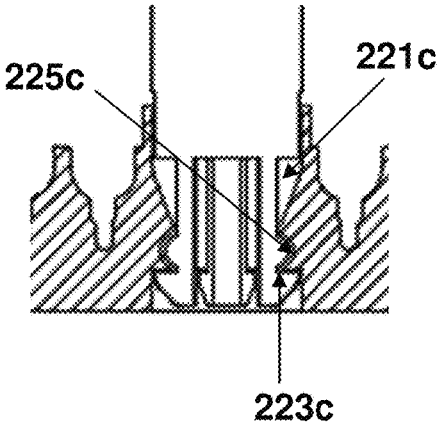

Another illustrative but not necessarily preferred embodiment of an item holder is item carrier 201*c* shown in FIGS. 2C-1-2C-5B. As shown in FIGS. 2C-1 and 2C-2, the item carrier 201*c* may have a connector 240*c* that provides an alternative pivotable connection 242*c*. As shown in FIGS. 2C-1 and 2C-2, the connector 240*a*, disposed between a handle 210*c* and a cross-piece 220*c*, may have a post 230*c* arranged to be joined at its upper end to the bottom of the near end 216*c* of the handle 210*c*. The connector 240*c* may have a connection member 231*c* integrated into or fixed to a lower end of the post 230*c*.

The connection member 231*c*, shown in more detail in FIGS. 2C-3A-2C-3C, may have a series of flexible, flanged fingers 234*c* extending downwardly to connect to complementarily shaped recess 221*c* in the cross-piece 220*c* shown in FIGS. 2C-4A, 2C-4B. As shown in FIGS. 2C-3A-2C-3C, a flanged finger 234*c* (which may be formed of a flexible plastic) may have an outwardly extending flange 236*c* at the bottom of the finger 234*c*, and have a retaining element 235*c*, which may be a protrusion that is formed on the outwardly facing surface of the finger above the flange. In certain embodiments such as the connection member 231*c* shown in FIGS. 2C-3A-2C-3C, the protrusion may be semi-spherical. In other embodiments, the retaining element 235*c* may be a button pin (also known as a tubing button), which may be retractable into the interior of the connection member and when not retracted to is deployable with spring force to hold the connection member to the cross-piece.

The connection member 231*c* may be arranged to fit snugly into a complementary element in or on the cross-piece 220*c*. For example, the complementary element may be a flexible inset such as the inset 222*b* shown in use in FIG. 2B-1 in the item carrier 201*b*. Alternatively, and as shown in FIGS. 2C-5A-2C-5B, the connection member 231*c* may be arranged to fit snugly into a complementarily shaped recess 221*c*, which, in the embodiment shown in FIG. 2C-4A-2C-4B, and 2C-5A-2C-5B, may have an inner surface 222*c* that is shaped to be complementary with the outer circumferences of the sections of the connection member 231*c* along the length of the connection member, with the inner surface 222*c* arranged to receive and secure the connection member 231*c*. For example, the inner surface 222*c* may have a ridge 223*c*, which is complementary in height, width, and size to a flange of the finger 234*c*, and a ring 225*c* around the circumference of the inner surface 222*c*, with the ring 225*c* having a semi-circular cross-section and being sized and shaped to fit and contain the ring of retaining elements 235*c*.

In operation, when the connection member 231*c* is pushed into the complementarily shaped recess 221*c*, the fingers flex to fit the connection member 231*c* snugly into the complementarily shaped recess 221*c*, with the flanges tucked under the ridge 223*c*, and with the ring of retaining elements 235*c* fit into and contained within the ring 225*c*, with the fingers rotatable within the ring 225*c*, allowing the handle to pivot around the cross-piece, thus providing the item carrier 201*c* with a pivotable connection 242*c* between a handle 210*c* and a cross-piece 220*c*.

The connection member 231*c* and complementarily shaped recess 221*c* may be manufactured using any conventional process, including without limitation molding or selective removal of material from the cross-piece 220*c*. FIGS. 2C-6A-2C-6C shows one embodiment of a model of the material that may be subtracted from the cross-piece during manufacturing of the complementarily shaped recess 221*c*, with the outer circumference of the model 251*c* matching the outer circumferences of the sections of the connection member 231*c* along the length of the connection member to complement the inner surface 222*c* arranged to receive and secure the connection member 231*c*.

In another embodiment, instead of a ring 235*c* around the circumference of the inner surface 222*c*, the circumference of the inner surface may have a ring of semi-circular depressions that are sized and shaped to fit and contain the set of retaining elements 235*c*. In operation, when the connection member 231*c* is pushed into the complementarily shaped recess and the fingers flex to fit the flanges tucked under the ridge 223*c*, the retaining elements 235*c* fit snugly into the complementarily shaped depressions, providing the item carrier with a fixed and locking connection between a handle and a cross-piece. Further, with a twist, the connection member 231*c* may be locked into place in the cross-piece 220*c*, and with another twist, the member may be unlocked and pulled out of the cross-piece.

Figures 2, 2C, 3, 4, 5, 6, 6A:
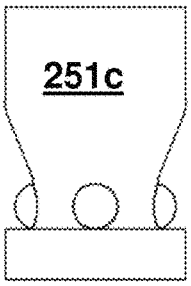
Figures 2, 2C, 3, 4, 5, 6, 6B:
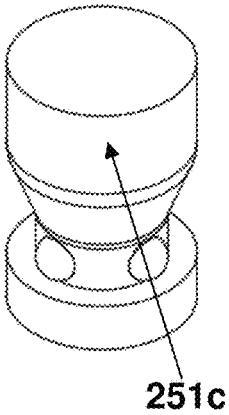
Figures 2, 2C, 3, 4, 5, 6, 6C:
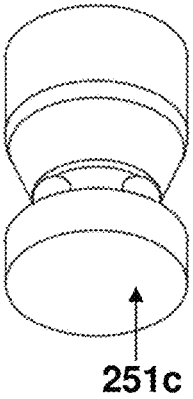
Figures 1, 2D:
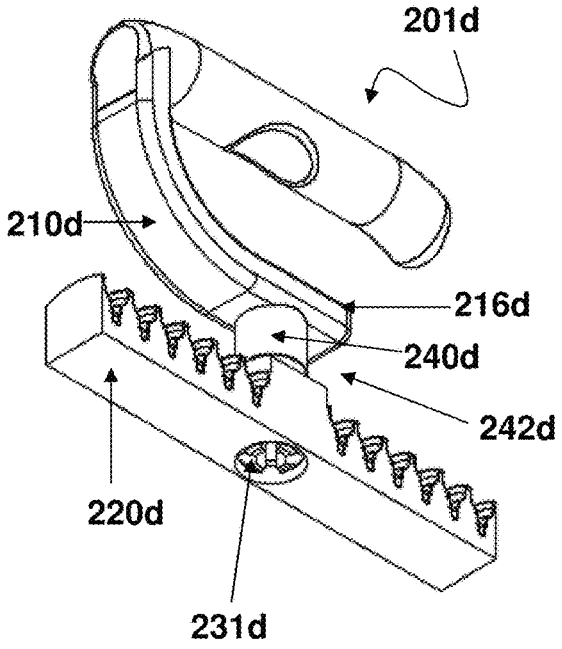
Figures 2A, 2D:
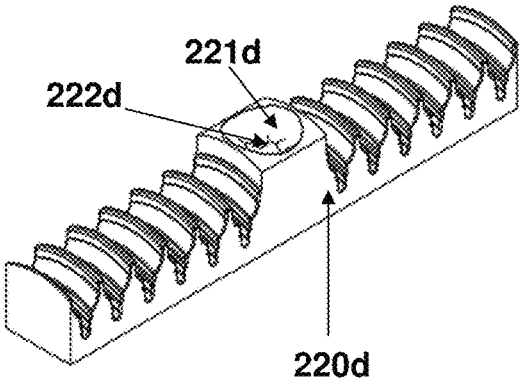
Figures 2B, 2D:
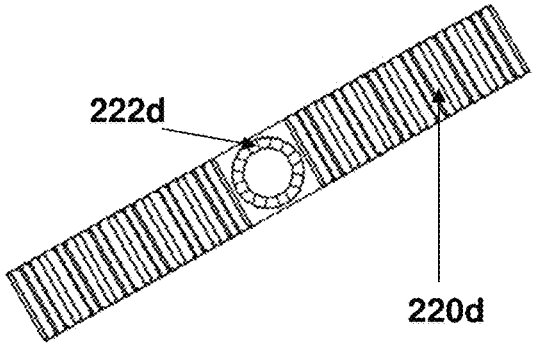
Figures 2, 2D, 3, 3A:
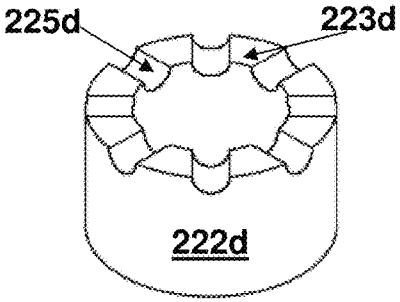
Figures 2, 2D, 3, 3B:
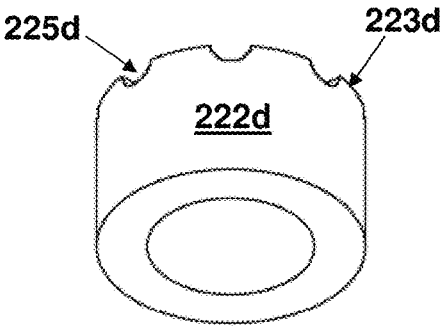
Figures 2, 2D, 3, 4, 4A:
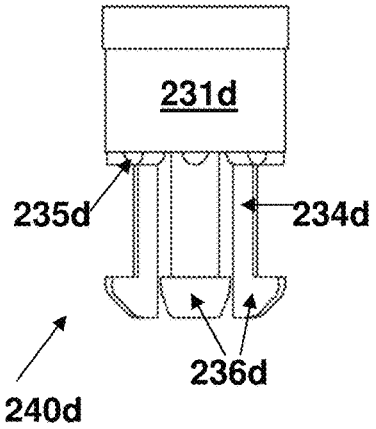
Figures 2, 2D, 3, 4, 4B:
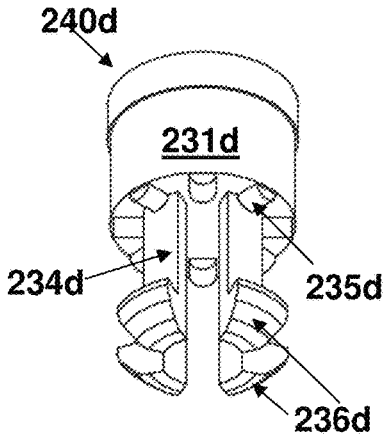

Another illustrative but not necessarily preferred embodiment of an item holder is item carrier 201*d* shown in FIGS. 2D-1-2D-5B. As shown in FIG. 2D-1, the item carrier 201*d* may have a connector 240*d* providing another alternative pivotable connection 242*d* between a handle 210*d* and a cross-piece 220*d*. As shown in FIGS. 2D-4A-2D-4C, the connector 240*d* may be arranged at its upper end to be joined or integral with the bottom of the near end 216*d* of the handle 210*d*.

The connector 240*d* may have a connection member 231*d*, which is further arranged to be joined with an inset 222*d* fitted into or integral with the cross-piece 220*d*. The connection member 231*d*, shown in greater detail in FIGS. 2D-4A-2D-4C and shown fit into cross-piece 220*d* in the cross-sectional views FIGS. 2D-5A-2D-5B, may have an upper portion with a lower surface having a series of retaining elements 235*d* disposed thereon in a circle near or at the edges of the lower surface of the upper portion. The elements may be protrusions formed on the lower surface. In certain embodiments such as the connection member 231*d*, the protrusions may be semi-spherical. In other embodiments, the retaining elements 235*d* may be a button pin (also known as a tubing button), which may be retractable into the interior of the connection member and when not retracted to is deployable with spring force to hold the connection member within the inset 222*d* (described below). The lower surface also may have flexible, flanged fingers 234*d* downwardly extending therefrom, with the fingers arranged in a circle interior to the circle of protrusions 235*d*. A finger 234*d* may be formed of a flexible plastic and have an outwardly extending flange 236*d*, for example on its lower end.

The inset 222*d*, shown in more detail in FIGS. 2D-3A and 2D-3B, which may be integrated into or fixed to the recess 221*d*, may be generally tubular in shape, with a circumference sized to fit into a recess 221*d* in the cross-piece 220*d*. The inset 222*d* further may have an upper surface 223*d* with semicylindrical cutouts 225*d* disposed in a circle around its upper surface. The cutouts 225*d* may be complementary in size, shape and position with the protrusions 235*d* on the lower surface of the upper of the connection member 231*d*. The inset 222*d* further may have a length sized to accommodate the length of the fingers from the lower surface of the upper portion of the connection member 231*d* to the flanges 236*d*.

The cross-sectional view of the assembled item carrier 201*d*, illustrated in FIGS. 2D-5A, 2D-5B, shows the inset 222*d* fit into the recess 221*d* of the cross-piece 220*d* and the connector 240*d* fit into the recess 221*d*, with the protrusions 235*d* fitting into the semicylindrical cutouts 225*d* of the inset 222*d* and with the flanged fingers 234*d* tucked under the lower edge of the inset 222*d*.

FIGS. 3A-3E are views of item carriers with alternative exemplary connectors between handles and cross-pieces. FIG. 3A shows an item carrier 301*a* featuring a handle-to-cross-piece cross connection 342*a* with a cross shaped aperture 315*a* extending through the near end 316*a* of the handle 310*a* of the item carrier, and a cap screw 350*a* (shown in FIG. 3A with its threaded shaft 352*a* shortened to simplify illustration of the connection 342*a*) that is arranged to screw into an aperture 326*a* in a box 322*a* attached to or integral with and positioned on the top surface of a cross-piece 320*a*. The box 322*a* may have a sprocket 328*a* with a cross-section that is shaped and sized to be complementary with the cross shaped aperture 315*a*.

In operation, the cap screw 350*a* is inserted into the aperture 315*a* and tightened into the box 322*a* until the sprocket 328*a* is fitted into the hole 315*a*. The handle-to-cross-piece cross connection 342*a* may be fixed when the box 322*a* and sprocket 328*a* are adhered to the cross-piece 320*a*, and the connection may be made pivotable by loosening the screw, separating the handle, rotating a selected increment, replacing and reattaching the screw. The angle of the handle relative to the cross-piece may be modified by loosening the cap screw, lifting the handle off of the sprocket, and fitting the sprocket into the cross-shaped aperture with the teeth of the sprocket fitted in the indentations in the cross-shaped aperture in a different alignment. Further, the connection 342*a* may be pivotable when the box 322*a* and/or the sprocket 328*a* are rotatably attached to the cross-piece 320*a* to allow the cross-piece to pivot around the cap screw 350*a*. In certain embodiments, the pivotable connection may be made fixed by screwing the cap screw 350*a* firmly into the cross-piece box 322*a*.

FIG. 3B shows an item carrier 301*b* featuring a handle-to-cross-piece star connection 342*b* which is similar in design and operation to the handle-to-cross-piece cross connection 342*a* of the item carrier 301*a*, with a difference between them being that the aperture 315*b* and complementary sprocket 328*b* have star-shaped cross-sections instead of cross-shaped cross-sections. As with the connection in the item carrier 301*a*, the connection in item carrier 301*b* may be made pivotable by loosening the cap screw 350*b*, separating the handle, rotating a selected increment, replacing and reattaching the screw.

FIG. 3C shows an item carrier 301*c* featuring a handle-to-cross-piece knurl connection 342*c* which is similar in design and operation to the handle-to-cross-piece cross connection 342*a* of the item carrier 301*a*, with a difference between them being that the aperture 315*c* is circular in cross-section and the complementary element 328*c*, which may be a nut, on the cross-piece 320*c* is a knurled nut having a circular cross-section that is complementary in shape, size, and position to the cross-section of the aperture 315*c*. The knurls, which may be rolled into the material of the outer surface 327*c* of the nut in any conventional pattern of straight, angled or crossed lines, is provided on the outer surface 327*c* of the nut 328*c* to improve the grip of the nut 328*c* to the inner surface of the aperture 315*c* when the nut is disposed in the aperture. For even further improved gripping, the inner surface 317*c* of the aperture 315*c* may also be knurled. As with the connection in the item carriers 301*a*, 301*b*, the connection in item carrier 301*c* may be made pivotable by loosening the screw, separating the handle, rotating a selected increment, replacing and reattaching the screw.

Figure 3A:
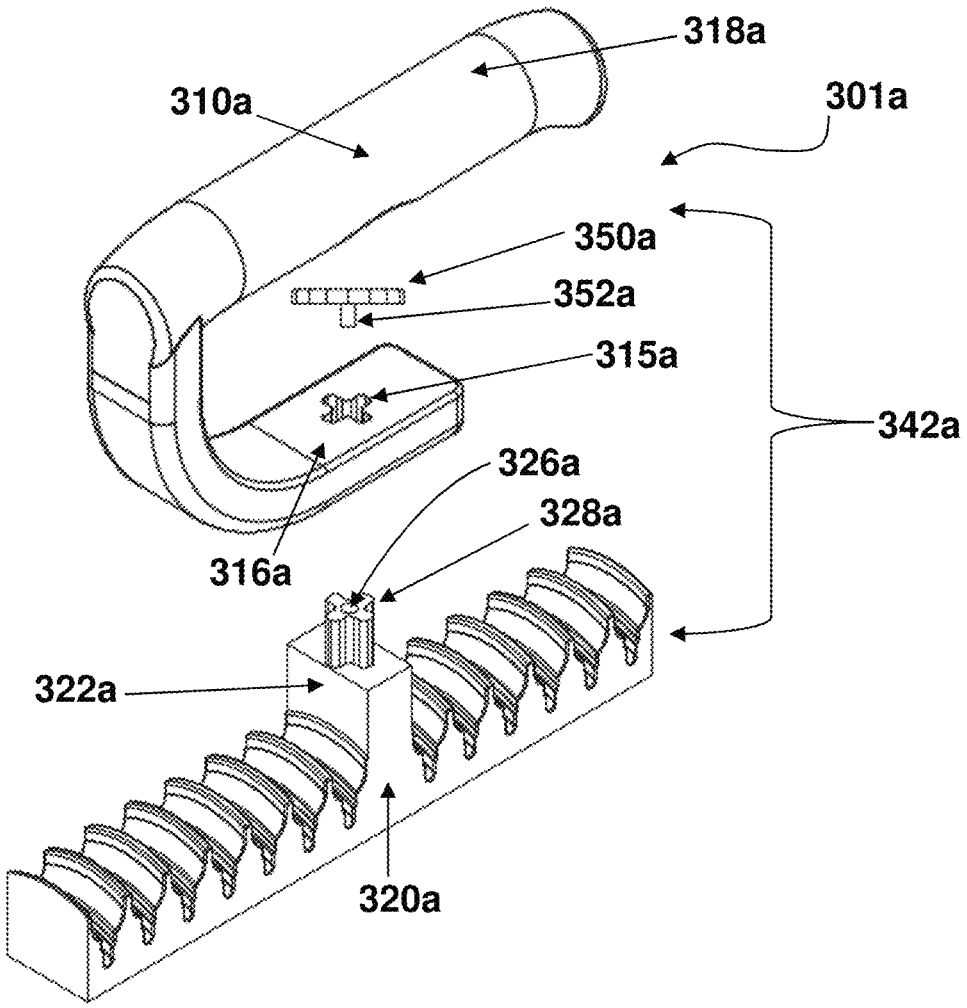
Figure 3B:
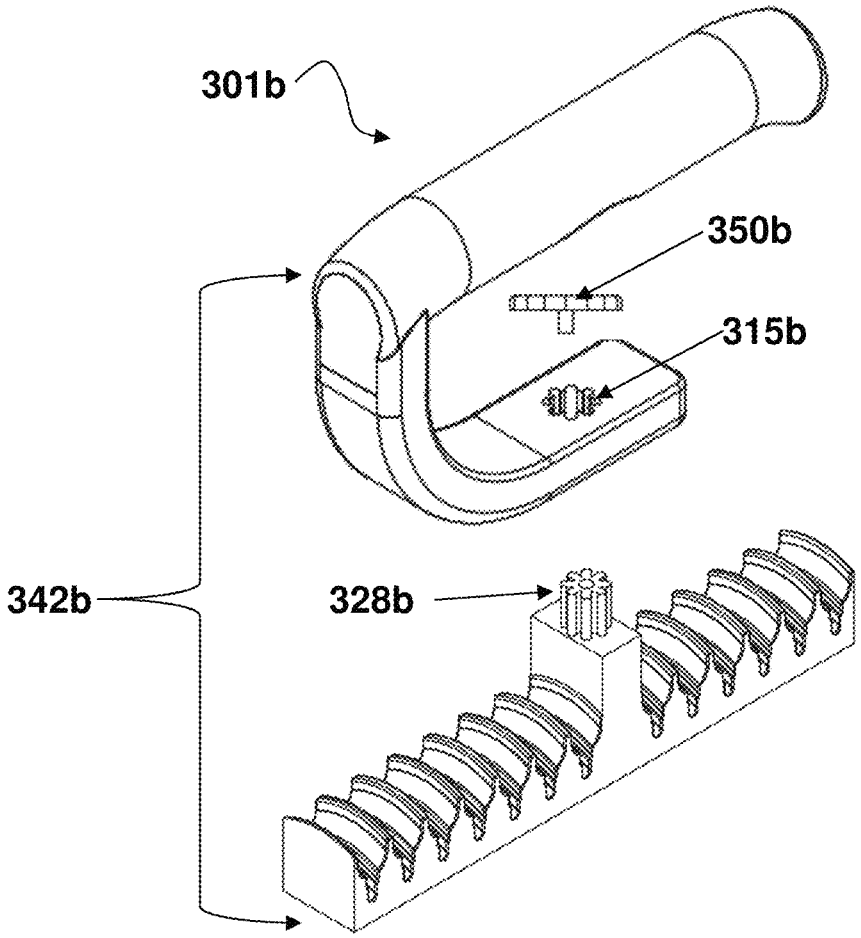
Figure 3C:
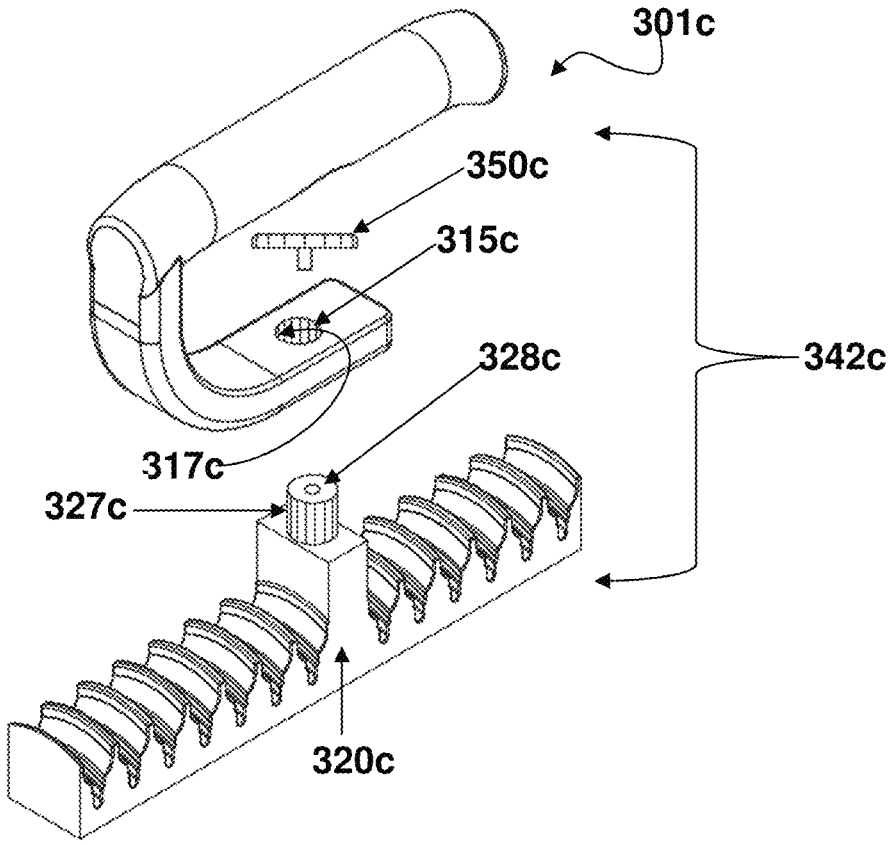
Figures 1, 3D:
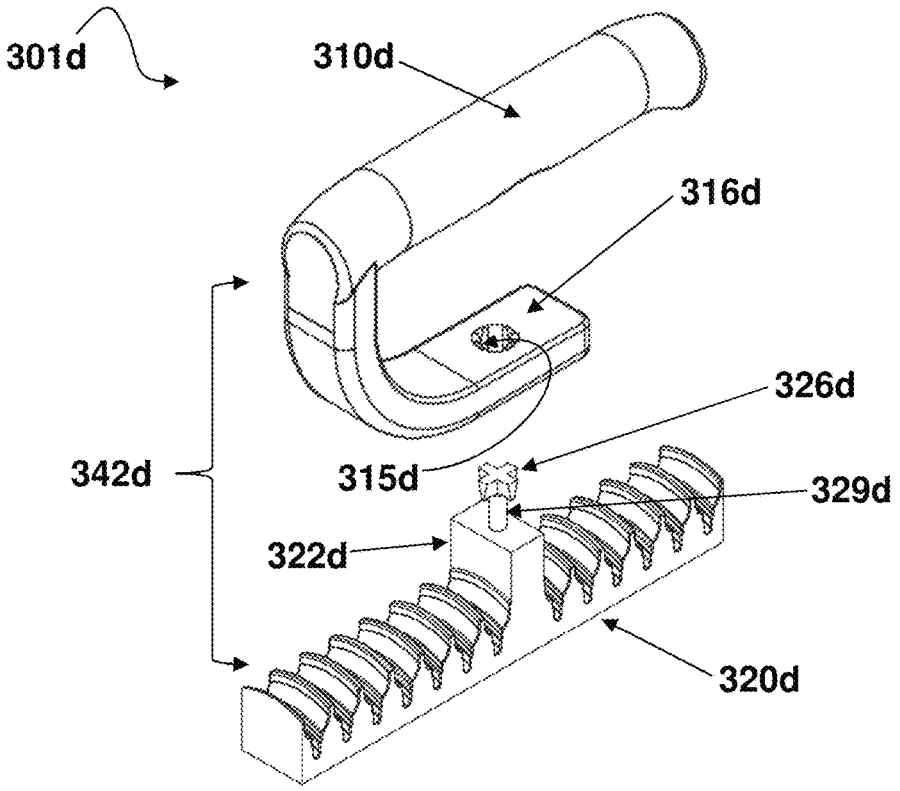
Figures 2A, 3D:
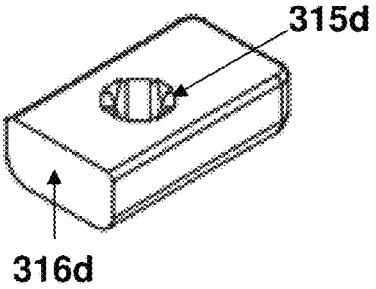
Figures 2B, 3D:
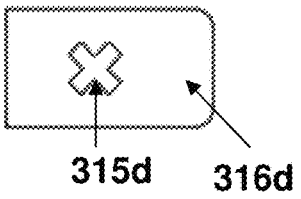
Figures 2C, 3D:
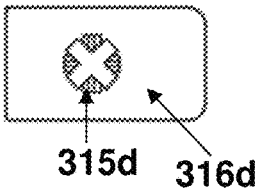
Figures 3A, 3D:
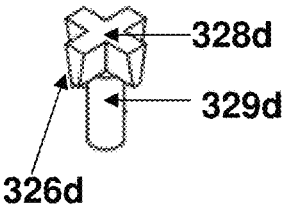
Figures 3B, 3D:
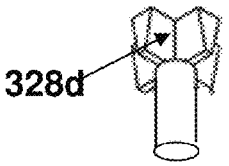
Figures 3, 3D, 4:
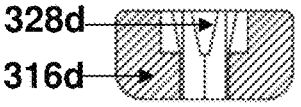

FIG. 3D-1 shows an item carrier 301*d* featuring a handle-to-cross-piece cross friction connection 342*d* having an aperture 315*d* extending through the near end 316*d* of the handle 310*d* of the item carrier and a cross-shaped sprocket 326*d* that is disposed atop a bar 329*d* that extends vertically from a box 322*d* attached to or integral with and positioned on on the top surface of a cross-piece 320*d*. Although it is not necessary, the bar may be cylindrically shaped. Further, its length may be at least as long as the length of the aperture 315*d*. It will be understood that the number of teeth on the sprocket 326*d* will be at the discretion of the designer, but, as shown in greater detail in FIGS. 3D-3A and 3D-3B, the sprocket 326*d* is cross-shaped and therefore has four sprocket teeth 328*d* extending around its circumference. Further, in this embodiment, the sprocket teeth 328*d* may have downwardly extending tapered sides along the length of the sprocket teeth, with the radial width of a sprocket tooth being greater at the upper surface of the sprocket tooth than at its bottom surface.

The aperture 315*d*, shown in greater detail in FIGS. 3D-2A-3D-2C and 3D-4, may have a bottom portion that may have a length that is less than or equal to the length of the bar 329*d*. The bottom portion may be a cross-shaped cuttout shaped to be complementary with the upper surface of the sprocket 326*d* and sized to receive the sprocket and bar, allow the bar to rotate therein and allow the bar and sprocket to pass therethrough.

The aperture 315*d* may also have an upper portion that is open to the top surface of the handle and is a cutout with a circular upper edge having a circumference sized to encompass the upper surface of the sprocket 326*d*, and with a length that is at least as long as the length of a sprocket tooth 328*d*. The lower edge of the support portion, which is adjacent to the upper edge of the bottom portion, has the same shape as the cross-shaped cuttout in the bottom portion. The wall of the upper portion between its lower edge and its circular upper edge may be shaped as follows:

It is complementary with the cross-shaped cuttout of the bottom portion to extend the cross-shaped cuttout the entire length of the aperture 315*d*; and It is also complementary with the sides of the sprocket 326*d*, albeit offset by 45 degrees from the complementary cross-shaped cuttout in the upper portion so that the wall portions complementary to the sprocket teeth 328*d* are disposed between the arms of the cross-shaped cutout.

In embodiments in which the sprocket teeth have tapered sides, the wall portions complementary to the sprocket teeth may be tapered as well. Further, the walls of the upper portion of the aperture 315*d* may have a serrated surface, arranged to provide a snug frictional fit of the sprocket teeth within the upper portion when the sprocket is fit into the aperture.

In operation, referring to FIGS. 3D-2A-3D-2C and 3D-4, the sprocket 326*d* may be inserted into the aperture 315*d* from the bottom surface 319*c* of the near end 316*d*, and through the aperture 315*d* until the sprocket teeth are positioned above the upper surface of the aperture 315*d*. A user may secure the sprocket so extended into the aperture by twisting the sprocket 45 degrees relative to the aperture and pulling or pushing the sprocket down into the upper portion so that the sprocket teeth fit snugly into the teeth shaped recesses in the upper portion's interior wall.

Throughout use, the connection in item carrier 301*d* may be made pivotable by pushing or pulling the sprocket up from the aperture, rotating the sprocket in increments of 90 degrees, and pushing the sprocket back into the aperture to secure the sprocket teeth against the wall of the aperture. The handle may be removed from the cross-piece by pushing or pulling the sprocket up from the aperture, rotating the sprocket by 45 degrees, and pushing the sprocket back into and then out of the aperture to remove the sprocket from the handle.

Figure 3E:
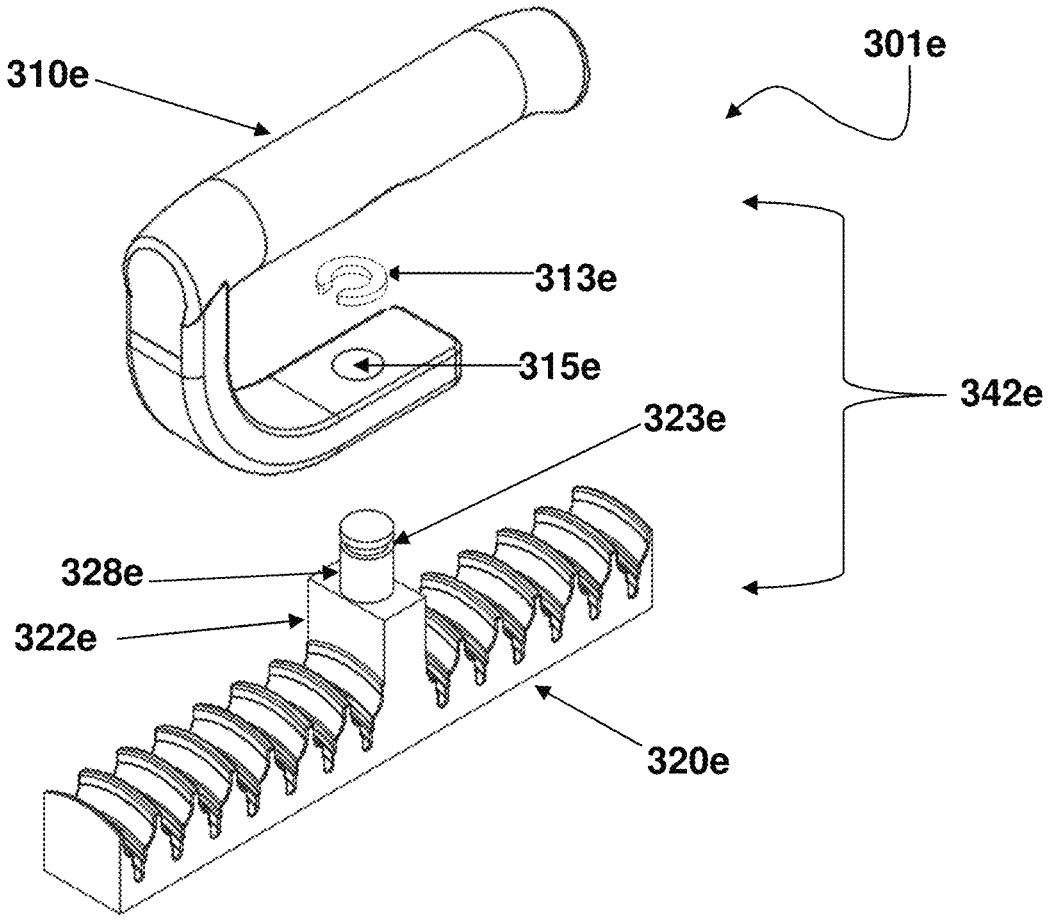

FIG. 3E shows an item carrier 301*e* featuring a handle-to-cross-piece snap ring connection 342*e* that is made pivotable by turning the handle against friction. The item carrier 301*e* may have a cylinder or tube 328*e* that extends vertically from a box 322*e* attached to or integral with and positioned on the top surface of a cross-piece 320*e*. The top portion of the tube 328*e* (which may be a rod, a post, or any convenient shape) has a groove 323*e* spaced a selected distance from the edge of the tube 328*e*. The item carrier also has an aperture 315*e* extending through the handle 310*e* of the item carrier, with the aperture 315*e* sized to receive the tube 328*e* below the groove 323*e* within it. In addition, the handle-to-cross-piece snap ring connection 342*e* has a snap ring 313*e* sized to surround and fit into the groove 323*e*.

In operation, the tube 328*e* may be inserted into the aperture 315*e* so that the groove 323*e* is disposed above the top surface of the handle 310*e*. The snap ring 313*e* then may be secured around the groove, preventing the tube 328 from slipping out of the recess 315*e*, thus securing the tube 328*e* within the aperture and securing the cross-piece to the handle. Because the tube is rotatable within the aperture, the cross-piece 320*e* is also rotatable around the handle 310*e*.

Other embodiments of connectors are contemplated, such as one in which a ratchet component may be used to click the connector into different configurations to change the orientation. Such connectors are useful in embodiments of the item carrier for which multiple orientation settings are desired.

Cross-Pieces

Turning to FIGS. 4A-4K, the cross-piece of an item carrier may be designed with several alternative upper surfaces upon which items may be hung and carried across the cross-piece. FIG. 4A is a perspective view of an exemplary generally straight and horizontal cross-piece 420*a* having an aperture 428*a* to receive the connection to the item carrier handle (not shown) and a plurality of partitions 410*a* disposed along its length, which extends from a near cross-piece end 424*a* to a far cross-piece end 426*a*. The cross-piece 420*a* may have one divider 425*a* projecting extending upwardly from the floor of the cross-piece 420*a* at the near cross-piece end 424*a*, and another divider 427*a* extending upwardly from the floor of the cross-piece at the far cross-piece end 426*a*. The partitions may be provided to keep items such as clothing on hangers distributed across the cross-piece to minimize shifting across the rail (keeping the weight of the items balanced across the item carrier and minimizing shifting make the items easier to carry).

A partition 410*a* may have dividers such as walls 412*a* (also referred to herein as divider walls) which may be formed of flat panels 414*a*, and a mid-section 411*a* between a pair of dividers 412*a*, with at least one portion of the first divider extending upwardly from the floor of the cross-piece a first selected height, with at least one portion of a second divider extending upwardly from the floor of the cross-piece a second selected height, and with a mid-section 411*a* extending between the first divider and the second divider and extending upwardly from the floor of the cross-piece a third selected height that is less than the first selected height and that is less than the second selected height. A partition 410*a* may be sized so that the mid-section has a length that is slightly greater than or approximately the width of an item so as to secure the item within a partition 410*a*. A partition 410*a* may also be sized so as to secure multiple items between its walls.

FIG. 4B is a perspective view of an exemplary generally straight and horizontal cross-piece 420*b* having an aperture 428*b* to receive the connection to the item carrier handle (not shown), and with partitions 410*b* having dividers such as walls 412*b* formed of rods 414*b* extending upward from an upper surface 422*b* of the cross-piece 420*b*, which extends from a near cross-piece end 424*b* to a far cross-piece end 426*b*. The cross-piece 420*b* may have one divider 425*b* projecting extending upwardly from the floor of the cross-piece 420*b* at the near cross-piece end 424*b*, and another divider 427*b* extending upwardly from the floor of the cross-piece at the far cross-piece end 426*b*.

Rods are useful dividers because multiple items may be easily draped over rods. Rods may operate as hooks for hanging items that does not typically get hung on hangers, for example, bras, underwear, purses, and belts.

Figures 2, 2D, 3, 4, 4C:
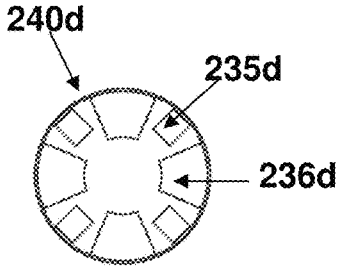
Figures 2, 2D, 3, 4, 5, 5A:
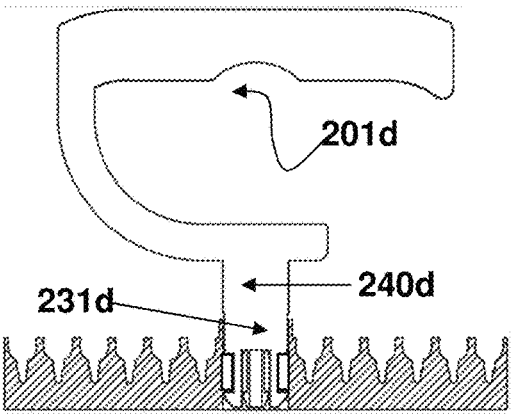
Figures 2, 2D, 3, 4, 5, 5B:
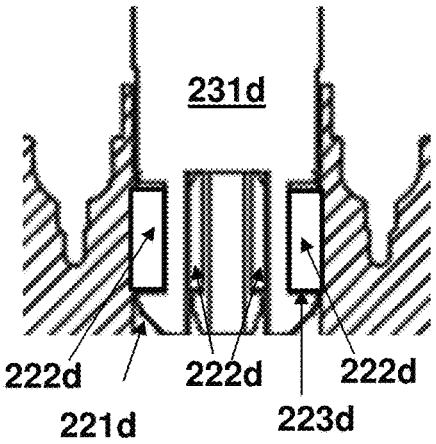
Figure 4A:
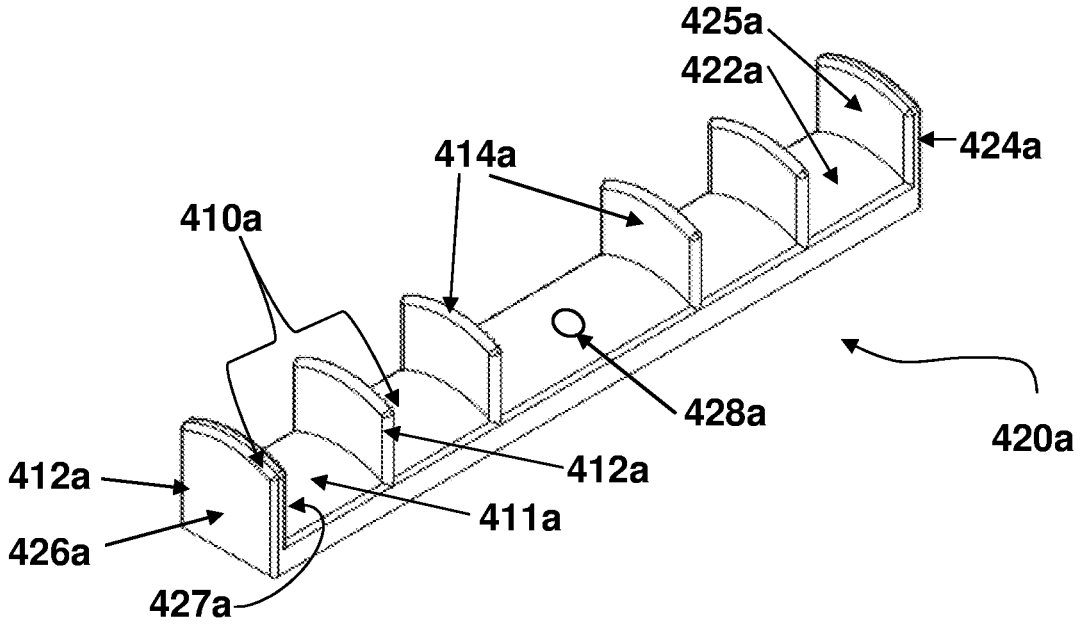
Figure 4B:
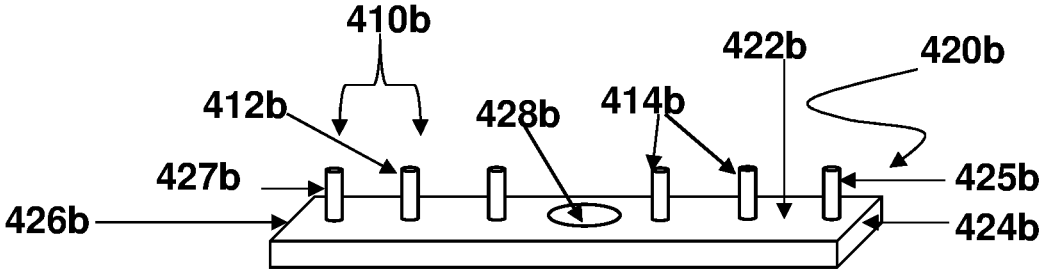
Figure 4C:
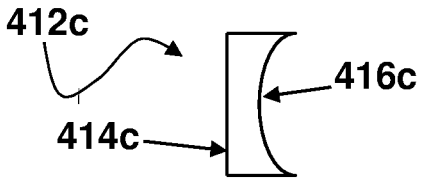
Figure 4D:
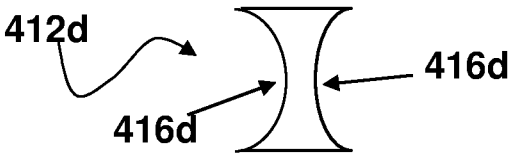

FIG. 4C is a perspective view of an exemplary divider wall 412*c* having a plane 414*c* on a first side and a concavity 416*c* on the second side. Divider walls 412*c* are well adapted to contain items in a partition. The concavity of the divider wall 412*c* shapes the partition defined by the walls 412*c* and the crosspiece upper surface so that the partition's opening is narrower than its middle, and its floor is narrower than its middle. In operation, items disposed within the partition are contained more securely within the partition. They are wedged into the partition more strongly by gravity and are more unlikely to slip out of the partition should the cross-piece be tilted off of horizontal alignment. Further, when the divider walls are formed of a flexible, bendable material, the dividers wall may bend apart to receive an item and to bend back to shape to capture the item more snugly in the partition. FIG. 4D is a perspective view of an exemplary divider wall 412*d* with a concavity 416*d* on both sides of the wall 412*d* so as to define a partition that is a more pronounced narrowing of the partition on its floor and at its opening to contain the items even more securely than the partitions of FIG. 4C. Providing concave surfaces of both sides of a divider wall 412*d* may improve the divider wall's ability to contain items within a partition.

Figure 4E:
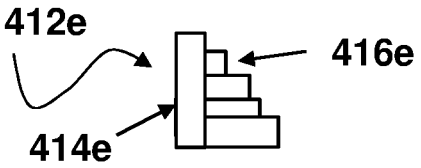

FIG. 4E is a perspective view of an exemplary divider wall 412*e* with a plane 414*e* on a first side and tiers 416*e* on its second side. The tiers are sized to cause the distance across a partition to increase from a bottom tier at the upper surface of a cross-piece to a top tier so that items of varying widths may be securely contained in a partition. In addition, the decreasing distance across a partition as an item is guided into a partition may catch the item more securely into the partition.

Figure 4F:
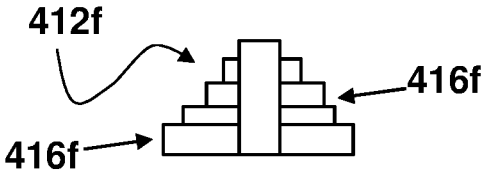

FIG. 4F is a perspective view of an exemplary divider wall 412*f* with tiers 416*f* on both sides of a divider wall 412*f*. Providing a partition with tiered walls 412*f* on both faces may improve the divider wall's ability to contain items within the partition. Partitions formed of tiered dividers have tiers that increase in width across the cross-piece from a bottom tier at the cross-piece to a top tier, with tiers 416*f* on a divider 412*f* on one side of a partition corresponding in position, width, and height to tiers 416*f* on the wall on the other side of the partition. Thus, the distance between corresponding tier pairs increases to form spaces of increasing width across the partition, with the shortest distance between tiers at the surface of the cross-piece. The pyramids formed by the tiers may be useful in accommodating hangers of varying widths.

It may be noted that the tiers need not be formed of straight surfaces such as those in FIG. 4F. The cross-pieces shown in FIGS. 1A-4, 1B-4, 1C, 2B-4B, and 7A-2 have tiered dividers in which the some of the tier surfaces are curved. Such tiered dividers form partitions that are particularly effective in securely containing hangers of varying widths, especially when the dividers are formed of a material that is pliable or has some elasticity, such as rubber, silicone, or neoprene, allowing the hangers to press into the sides of a partition.

It is the designer's choice how to organize partitions and dividers along the cross-piece. The partitions may be of uniform or varying widths to accept hangers of varying widths or clothes of varying thicknesses. The partitions may be sized to accept one or multiple hangers as well. It is not necessary for each of the dividers on a cross-piece to be of the same type, nor is it necessary for all the partitions to be the same size. The designer may select to incorporate multiple lengths of partitions and multiple types of dividers to accommodate desired functionalities. For example, the dividers on the cross-piece need not be the rods, panels, or tiered walls described above; instead, the upper surface of a cross-piece may have multiple types of recesses to function as partition mid-sections and protrusions to function as partition dividers to contain items onto an upper surface of a cross-piece.

Cross-pieces may have upper surfaces formed with grooves, scallops, waves, and zigzags with varying width and depth characteristics to hold different size hangers or items and to enhance control of the clothes while carrying them.

Figure 4G:
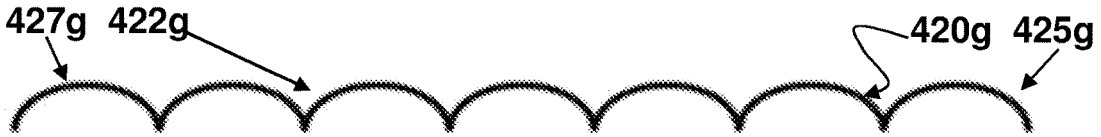

FIG. 4G shows a grooved upper surface 422*g* of an exemplary cross-piece 420*g* with one divider 425*g* projecting upwardly from the floor of the cross-piece 420*g*, and another divider 427*g* extending upwardly from the floor of the cross-piece 420*g;*

Figure 4H:
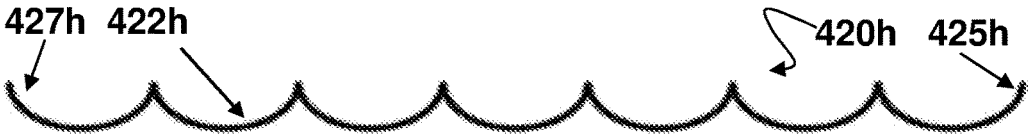
Figure 4I:
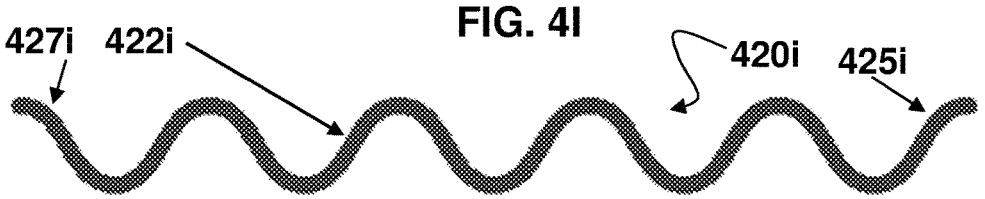
Figure 4J:
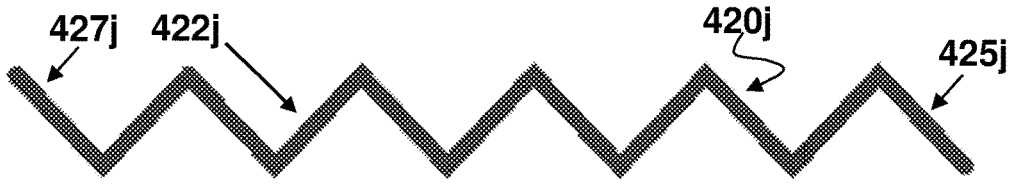

FIG. 4H shows a scalloped upper surface 422*h* of an exemplary cross-piece 420*h* with one divider 425*h* projecting upwardly from the floor of the cross-piece 420*h*, and another divider 427*h* extending upwardly from the floor of the cross-piece;

FIG. 4I shows a sinusoidal upper surface 422*i* of an exemplary cross-piece 420*i*, with one divider 425*i* projecting upwardly from the floor of the cross-piece 420*i*, and another divider 427*i* extending upwardly from the floor of the cross-piece 420*i*; and FIG. 4J shows a zigzag upper surface 422*j* of an exemplary cross-piece 420*j*, with one divider 425*j* projecting upwardly from the floor of the cross-piece 420*j*, and another divider 427*i* extending upwardly from the floor of the cross-piece 420*j*.

Figure 4K:
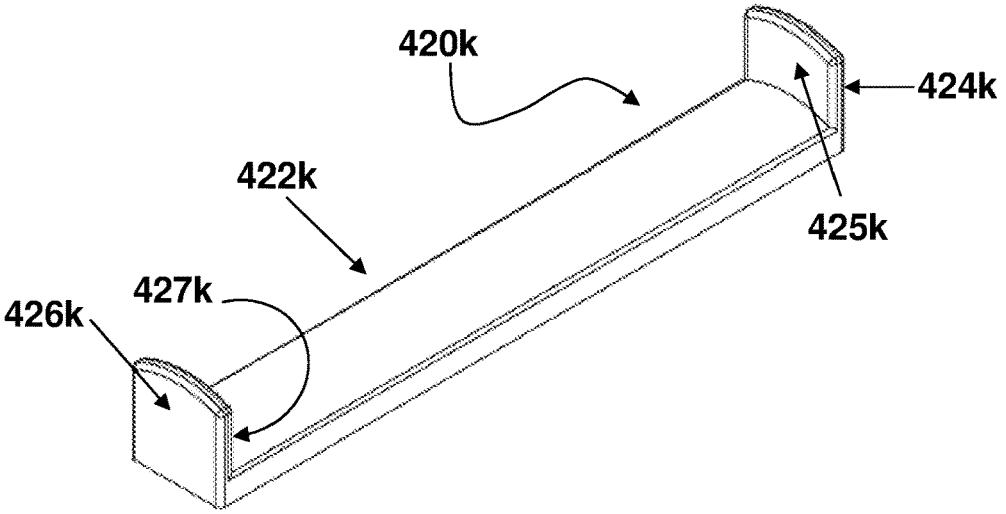

Further, as shown in FIG. 4K, a cross-piece 420*k* may have a single partition that extends end to end across the upper surface 422*k* of the cross-piece 420*k*, with the single partition formed by one divider 425*k* projecting upwardly from the floor of the cross-piece 420*k* at the near cross-piece end 424*k*, and another divider 427*k* extending upwardly from the floor of the cross-piece at the far cross-piece end 426*k*.

No matter the style of partition that is selected by the designer for the cross-piece, in certain embodiments, the cross-piece may be supplied with anti-slip features to prevent the items being transported thereon from shifting on the cross-piece and to maintain the balance of weight across the cross-piece. The materials and ergonomic features described above for providing an anti-slip surface for the hand-graspable section may be also applied to the cross-piece.

In use, the item carrier 100 may be filled with items that are draped over the cross-piece, hung from at least one hook (not shown) on the cross-piece, or suspended on hangers which are hooked over the cross-piece. A user may load a cross-piece with desired items such as clothing on hangers, distributing the items' weight and bulk across the cross-piece as is convenient to the user. When dividers are organized on the cross-piece to form partitions of varying widths, the user may load the items so that an item of a selected width is loaded into a correspondingly wide partition on the other side of the cross-piece. Further, when a second partition is defined with at least one tiered divider, the user may load a second item into the second partition with a tiered divider with less concern for the width of the second item because the tiered divider provides the second partition with a variety of widths. The user may hand carry the item carrier to another location, or hook it to another carrier, or suspend the item carrier from another organizer for longer-term storage of the items.

Transporting and Mounting Item Holders

Figure 5A:
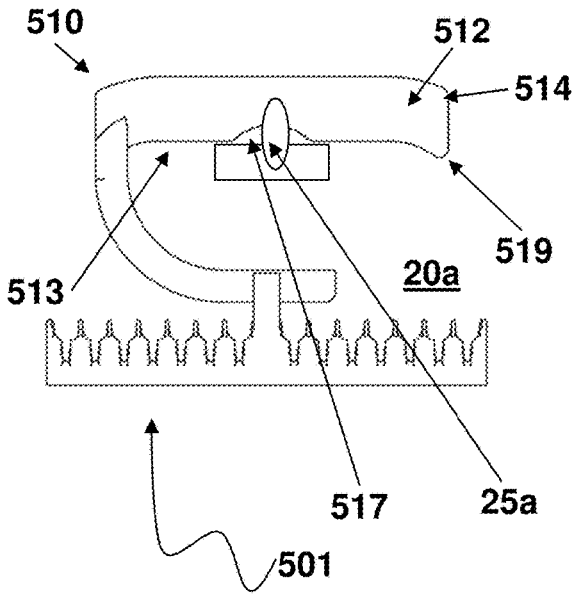
Figure 5B:
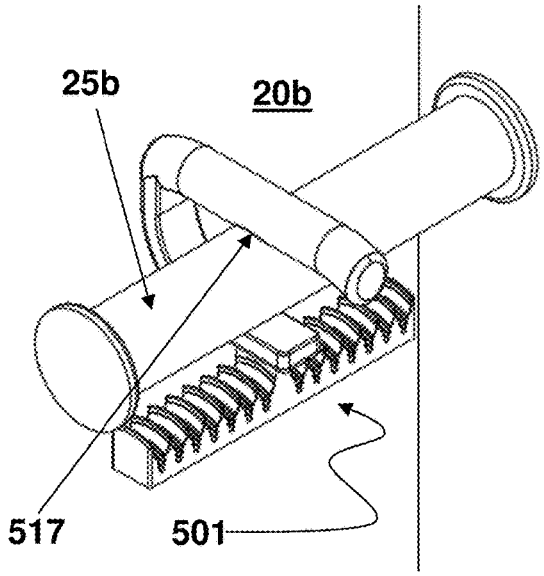
Figures 1, 5C:
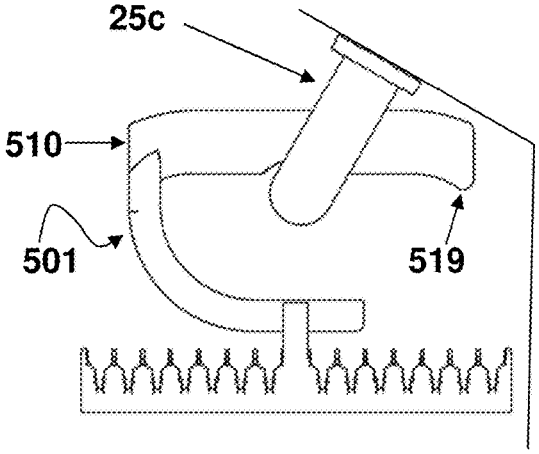
Figures 2, 5C:
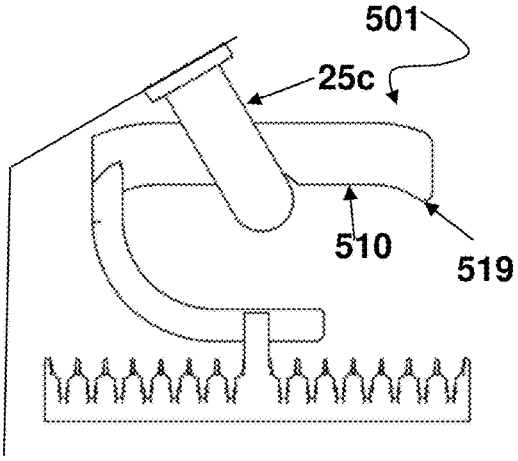

Turning to FIGS. 5A-5J, the hand-graspable section 512 of a handle 510 of an item carrier may have a cross-piece-facing lower surface 513 with a handle indentation 517 sized to receive any suitable article-carrying holder, such as a hand, a hook 25*a* on a wall 20*a* (FIG. 5A), a conventional closet rod 25*b* in a closet 20*b* (FIG. 5B) (the rod may be round or any other shape in cross section, or a hook or hanger bar 25*c* on the interior of an automobile (FIGS. 5C-1, 5C-2). Further, as shown in FIG. 5A, the far end 514 of the hand-graspable section 512 may extend downwardly toward the cross-piece 120. The downward extension of the far end 514 forms a handle hook 519 to reduce the opportunity that the item carrier will slip off of an element upon which it had been hung, for example, off of a shelf or slot (such as shown in FIGS. 5D-5J) or off of a hanger bar 25*c* such as one on the interior of an automobile (shown in FIG. 5C-1 with the handle hook 519 pointing out to the exterior of the car, and in FIG. 50-2 with the handle hook 519 pointing to the interior of the car.

Figure 5D:
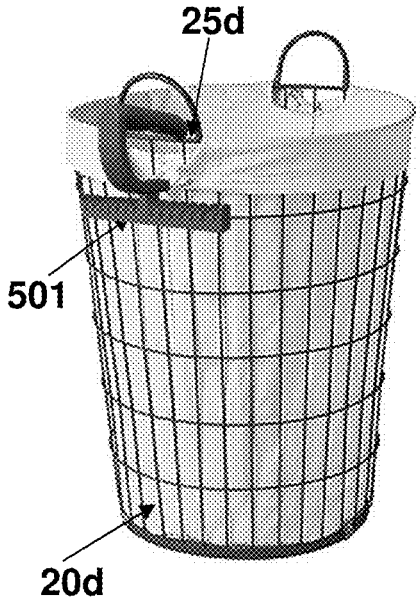
Figure 5E:
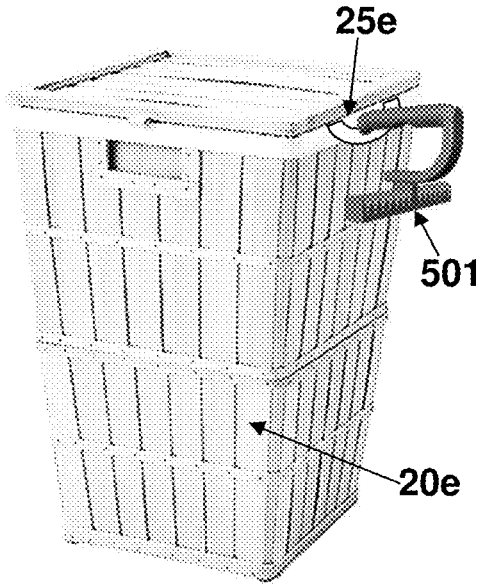
Figure 5F:
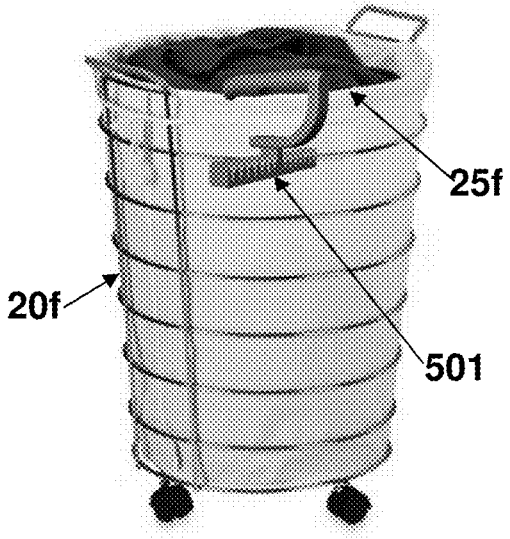
Figure 5G:
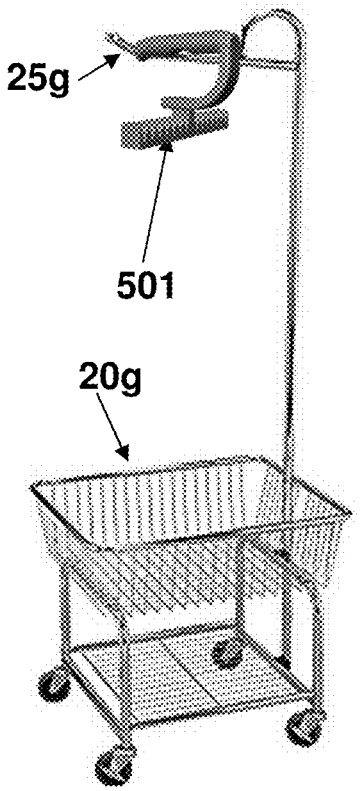
Figure 5H:
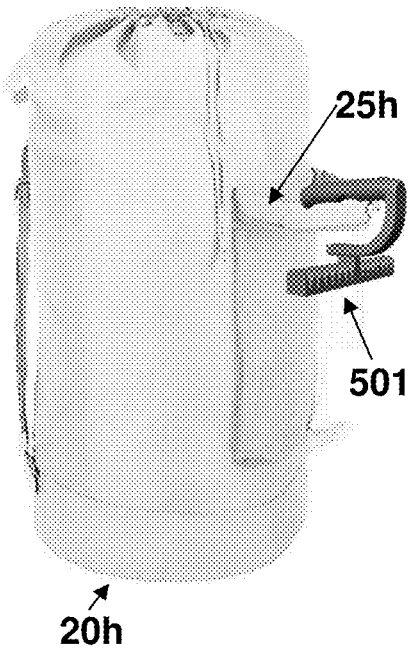
Figure 5I:
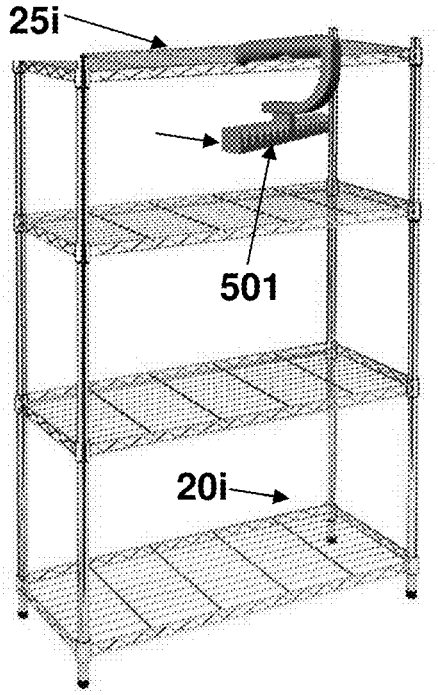
Figure 5J:
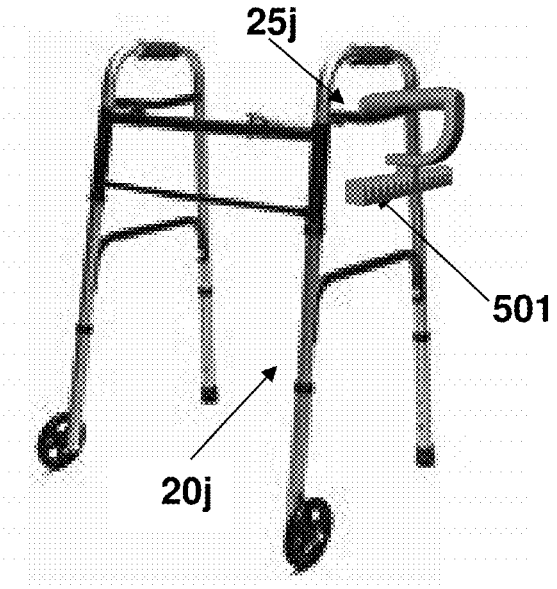

The handle recess 517 or handle hook 519 may also be used to deploy the item carrier from the side of or a hook, handle, or loop on or structural member of a myriad of article-carrying holders, including but not limited to a laundry basket (FIG. 5D, showing an item carrier 501 slipped over a handle 25*d* of the basket 20*d*), hamper (FIG. 5E, showing the item carrier slipped over a loop 25*e* on the top edge of the hamper 20*e*), rolling laundry basket (FIG. 5F, showing the item carrier 501 slipped over a horizontal rib 25*f* of the basket 20*f*), rolling laundry cart (FIG. 5G, showing the item carrier 501 slipped over a hanging rod 25*g* of the cart 20*g*), a backpack (FIG. 5H, showing the item carrier 501 slipped over a loop 25*h* on the rear of the backpack 20*h*), standing shelves (FIG. 5I, showing the item carrier 501 slipped over the edge of a shelf 25*i* of the standing shelves 20*i*), and a walker (FIG. 5J, showing the item carrier 501 slipped over a horizontal bar 25*j* on the frame of a walker 20*j*).

Item Holding/Storage Systems

An item holder or an item carrier may be used for more than transporting items. They may also be used to hold items in short-term storage or in longer-term storage when they are made a part of an item holding system 600*a* (also known as an item storage system). In further embodiments, the base may have a support bar, which may be a generally horizontal arm, upon which the item holder may be supported. In certain embodiments, the support bar may be permanently affixed to the base; in other embodiments, it may be releasably attachable to the base so that it may be used as a support bar in another base.

With reference to FIGS. 6A and 6B, the base onto which the item holder 601*a* may be releasably attachable may be a stand. As shown in FIG. 6A, the item holder 601*a* may be an item carrier such as the item carrier 101*a* of FIG. 1A-1 for transporting items such as clothing, and the base 605*a* may be a stand 650*a*, described below. Alternatively, as is shown in FIG. 6B, the item holder 601*b* may be a cross-piece 420*k* shown in FIG. 4*k*, the cross-piece 120 also as shown in FIG. 1A-1 (with no handle or with the handle of an item carrier removed), or the item holder 100*a* for holding items along its length, and a base 605*b*, which may be a stand 650*b*, described below.

As shown in FIG. 6A, the stand 650*a* may have a generally vertical leg 640*a*, a support bar 630*a* connected to the leg 640*a* at the leg's upper end 644*a* and to which the item holder 601*a* may be connected, and a footing 660*a* connected to the leg 640*a* at the leg's lower end 646*a*.

Figures 1, 7A:
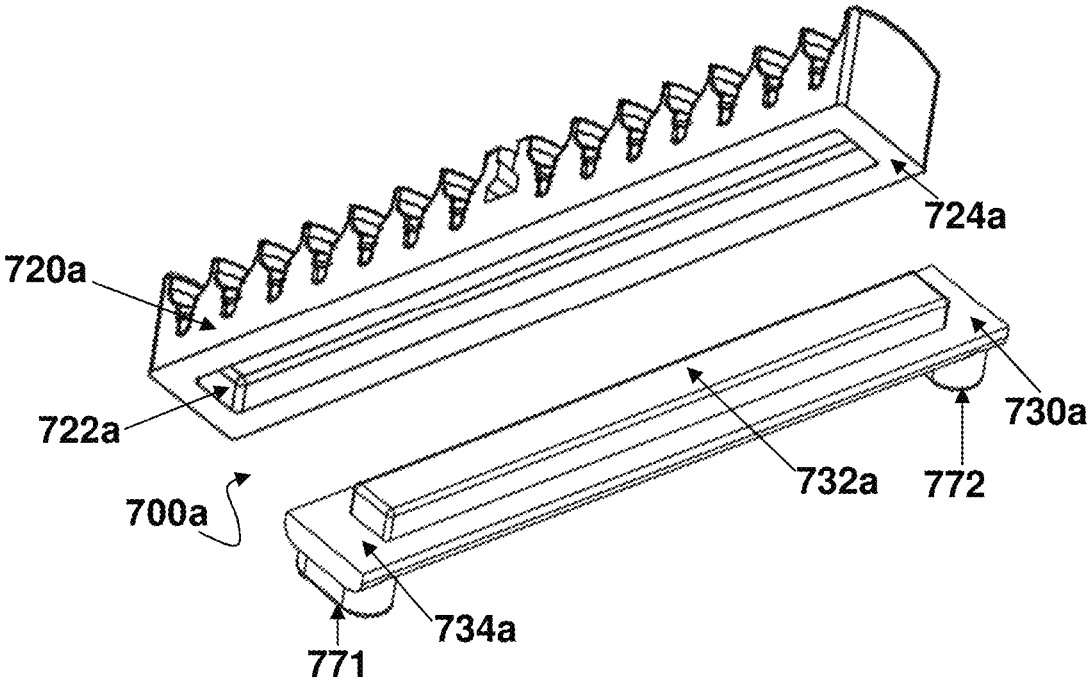
Figures 2, 7A:
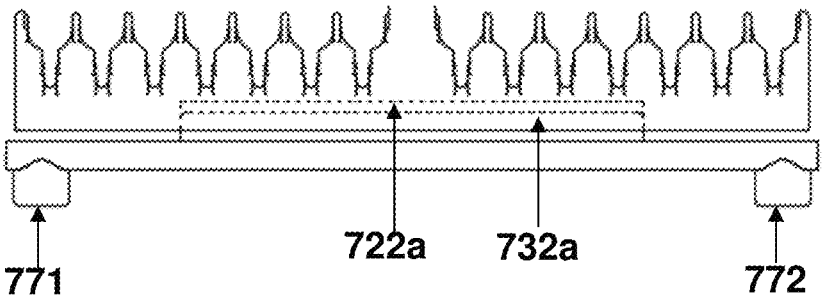
Figures 3, 7A:
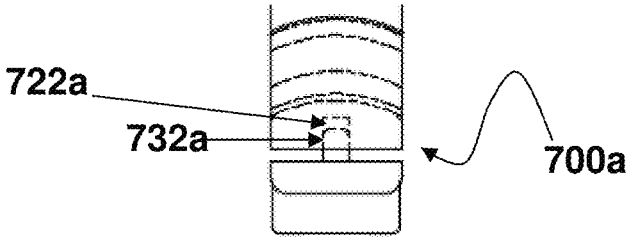
Figure 7B:
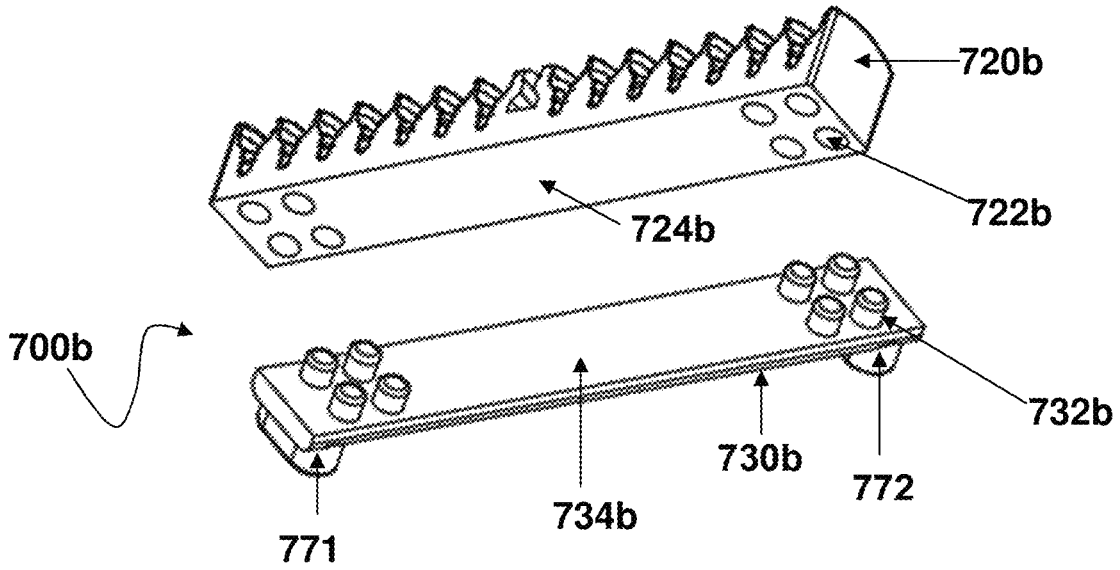

In certain embodiments, the cross-piece, item holder, item carrier, or support bar may have leg fittings, such as fittings 771, 772 shown in FIGS. 7A-1 and 7B into which or over which a leg may be fit snugly. In the embodiment shown in FIGS. 6A, the leg 640*a* may be hollow, such as a tube of any desirable cross-section; and the fitting on the support bar 630*a* may fit snugly into the hollow of the leg 640*a*. The leg 640*a* may be extensible to a plurality of lengths. For example, the leg 640*a* may be made of sections 643*a*-1, 643*a*-2, and 643*a*-3 that telescope to provide the leg 640*a* with a plurality of lengths. In certain embodiment, the cross-piece, item holder, or item carrier may be secured to the leg directly with screws, clips, or other fasteners. In other embodiments, the cross-piece, a support bar is temporarily attached to a leg, and an item holder or item carrier may be tightened to the support bar with screws or other fasteners. In other embodiments, the support bar 630*a* may be permanently attached to the base, for example, with gluing or by welding or soldering.

In an alternative embodiment, as shown in FIG. 6B, a stand 650*b* may have a generally vertical leg 640*b*, a footing 660*b* connected to the leg 640*b* at the leg's lower end 646*b*, and a support bar 630*b* pivotably connected to the leg 640*b* at the leg's upper end 644*b* such that in one configuration the support bar 630*b* may be disposed generally parallel to and flat against the leg (so that the support bar, when not in use to hold a cross-piece, may be folded up against the leg for ease of storage). In another configuration, the support bar 630*b* may be flipped over the upper end 644*b* and disposed generally horizontal to the leg 640*b* with a near end 632*b* of the support bar 630*b* disposed against the surface of the leg 640*b*. In another embodiment (not shown), a support bar may be attachable to a base leg with any other conventional attachment, including a collapsible support bracket that may be connected to both the support bar and leg and provide additional locking support to the support bar when the support bar is disposed perpendicularly to the leg.

Returning to FIG. 6A, the leg 640*a* may have a lower end 646*a* attachable to a footing 660*a* to form a free-standing rack. A footing may be any component that supports the weight of the rest of the item storage system and maintains its stability. It may be a heavy object, such as a weighted object, or a wide element that distributes the weight of the system over a wide area, or an object that provides a multi-point footing contact with the surface upon which the base 605*a* stands. The footing 660*a* shown in FIG. 6A is a weighted cylinder attached to the lower end 646*a* of the leg 640*a*. The footing 660*b* shown in FIG. 6B may be a tripod having a three-legged support that extends from the lower end 646*b* of leg 640*b*.

In certain embodiments, the base may have multiple legs. As shown in FIG. 6C, a base 605*c* may have a first leg 671 and a second leg 672. The stand may be a floor stand, with the far end of the first leg disposable at or near a floor. The length of the leg and the width of the base will be at the option of the designer, with a slender stand and tall legs forming a butler stand or valet stand, or with shorter legs creating a table top item storage system.

In FIG. 6C, the first leg has an upper end 674-1 and a lower end 676-1, and the second leg has an upper end 674-2 and a lower end 676-2. A support bar 630*c* may be attachable between the upper end 674-1 of the first leg and the upper end 674-2 of the second leg. The support bar 630*c* is similar in configuration to support bar 630*a*, modified to attach to both legs. In certain embodiments, the legs 671, 672 may be hollow and the support bar 630*c* may have a leg fitting at either end that that fits snugly into or over the legs. Alternatively, the support bar 630*c* may be attachable to the legs with any other conventional attachment. One embodiment of the support bar 630*c*, which is described in greater detail below with reference to FIG. 7B has leg fittings 771, 772 extending downward from each end that are sized to fit snugly into the hollow of a base leg, such as legs 671, 672, respectively.

A footing may be attachable to the lower end 676-1 of the first leg and the lower end 676-2. The footing 660*c* shown in FIG. 6C has stabilizing bars 661, 662 attached perpendicularly to the lower end 676-1, 676-2. respectively. Although it is not necessary to do so, the footing 660*c* has a footing connector 663 attached between and extending coplanar to stabilizing bars 661, 662. FIG. 6C also shows a small item-holding hook 652, shown in greater detail in FIG. 6E and a large item-holding hook 654, shown in greater detail in FIG. 6F, that may be attachable to the base 605*c* for hanging items that does not typically get hung on hangers, for example, bras, underwear, purses, and belts. The hooks 652, 654 may be hollow and slide over a leg 640*a* to attach to the base with a frictional fit or to sit atop a protrusion such as a button pin on the outside of the leg. A hook may also sit atop a stretchable O-ring that snugly fits over a leg 671. The O-ring may be formed of rubber or other suitable material and is adjustable along the length of the leg to a desired height, which may be selected by a user. The hooks may also attach to the leg with screws or other fasteners, or more permanently attach to the leg, for example, with gluing or by welding or soldering.

Figure 6A:
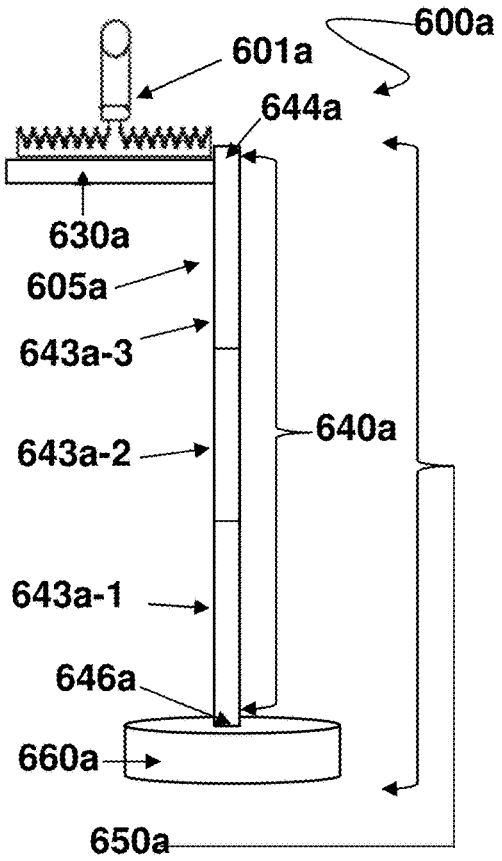
Figure 6B:
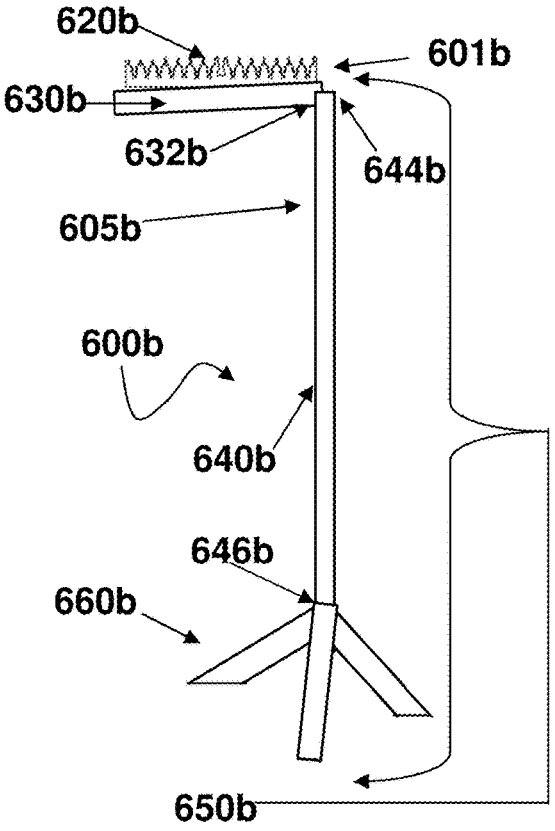
Figure 6C:
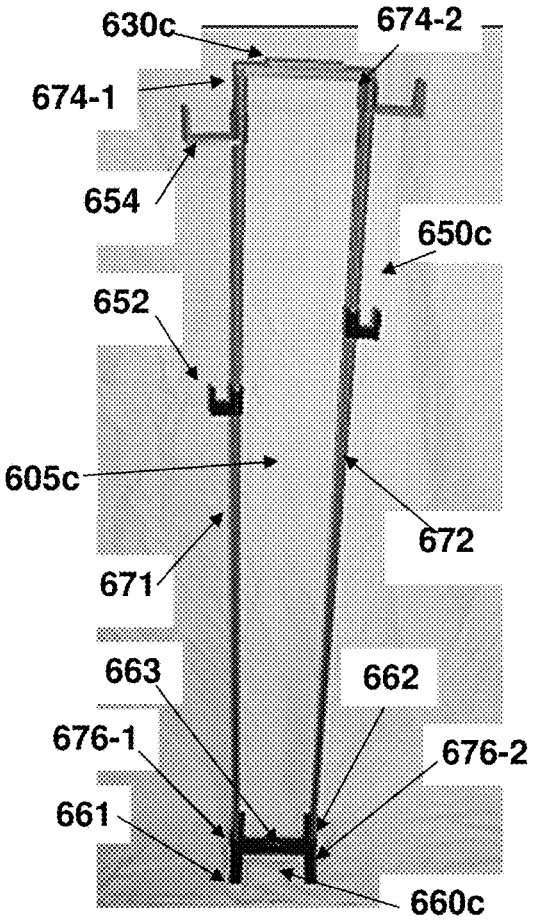
Figure 6D:
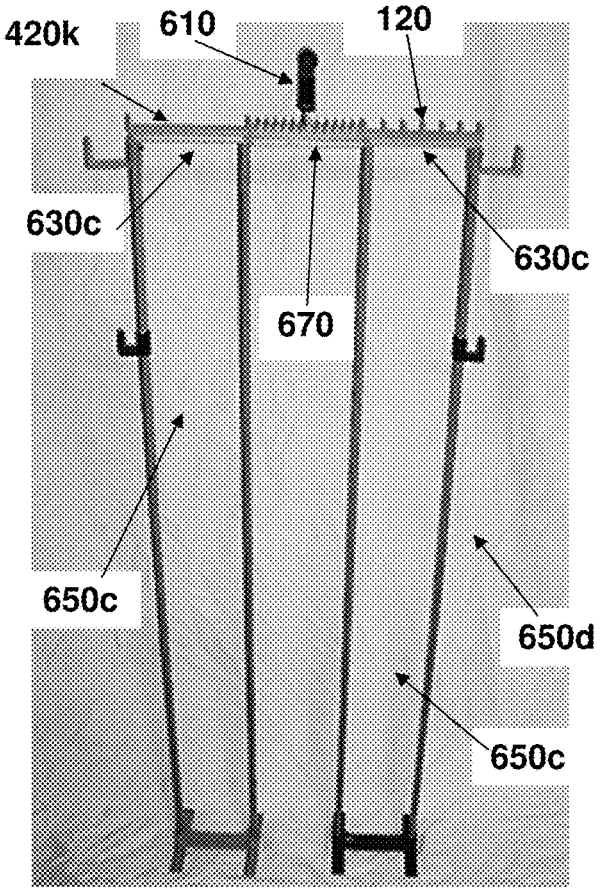
Figure 6E:
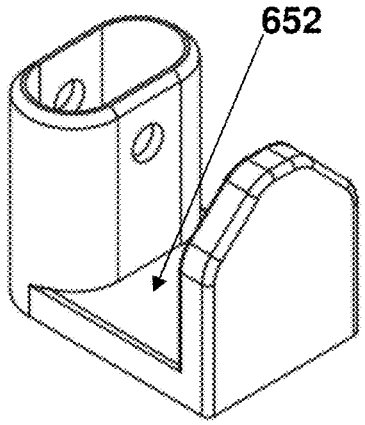
Figure 6F:
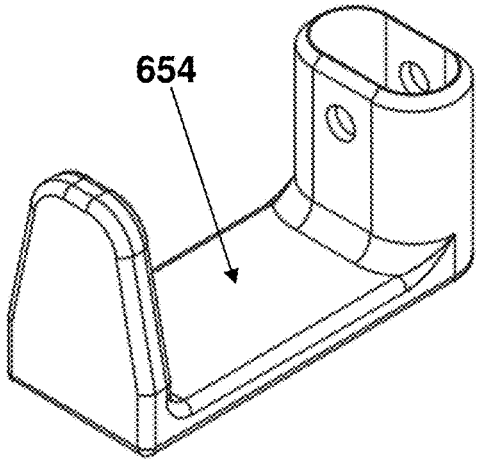

In certain embodiments, multiple stands may be attached together to form a larger stand. As shown in FIG. 6D, two stands 650*c* may be attachable to form a larger stand 650*d*, with the stands 650*c* attachable to each other by a support bridge 670 attached end-to-end between the support bars 630*c* of the stands 650*c*. In certain embodiments, a cross-piece, item holder, or item carrier may operate as a support bridge. In other embodiments, a support bridge may operate as a support bar to which a cross-piece, item holder, or item carrier may be releasably attached. As shown in FIG. 6D, the support bars 630*c* are arranged to bear an item holder, and so may the support bridge 670*d*. The item holders that may be attached to the larger stand 650*d* may be of the same type or, as shown in FIG. 6D, the item holders may be of different types. For example, the item holders in FIG. 6D are a cross-piece 420*k* having a single partition that extends end to end across the cross-piece 420*k*, an item carrier 100 with a cross-piece 120 connected to a handle 110, and a cross-piece 420*a* (shown in FIG. 4A with panel divider walls).

Figure 6G:
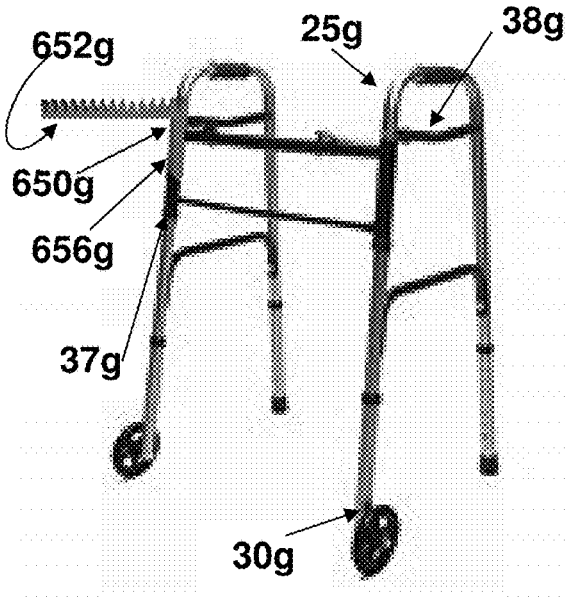

In other embodiments, the base of an item holder system may be a mount that is attachable to another support, device, or appliance. For example, as shown in FIG. 6G, a walker mount 650*g* may have a support bar 652*g*, which may be a generally horizontal arm, to which a cross-piece may be directly or indirectly attached, and a mount arm 656*g* that is permanently fixed or temporarily fixable to the walker 30*g*.

The mount arm 650*g* may be a pliable tubular element or have any other convenient shape that may snap over or otherwise be secured to a walker leg 37*g* for a mount arm vertical orientation, or snap over or otherwise be secured to a horizontal bar such as a frame bar 38*g* of the walker 20*j* for a mount arm vertical orientation.

Figure 6H:
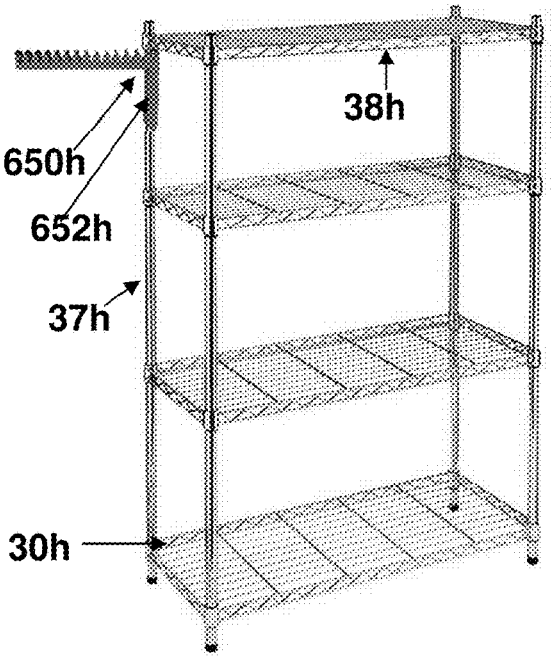

As shown in FIG. 6H, a shelf mount 650*h* may be connected to a conventional shelving unit such as a shelving unit 30*h*. The shelf mount 650*g* may also have a support bar 652*h*, which may be a generally horizontal arm, to which an item holder may be releasably attached, and a pliable tubular mount arm 652*h* having a semi-circular cross section. In embodiments in which the mount arm is generally vertical, the mount arm may be secured onto a shelf support 37*h* for example a clipping system. In embodiments in which the mount arm is generally horizontal, the mount arm may be clipped over and so secured onto a shelf 38*h*.

Figure 6I:
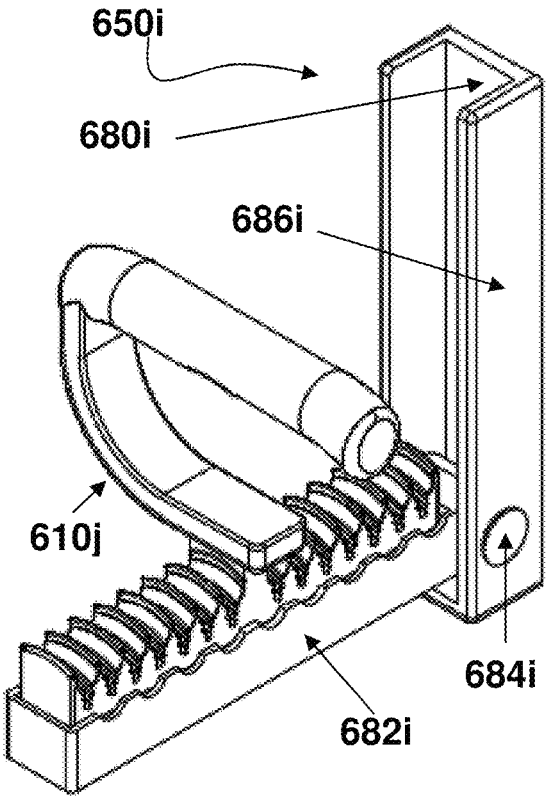

Further, instead of connecting the item holder to a free-standing base or hanging the item carrier on a hook, closet rod, shelf, slot, or bar, an item holder may be releasably attached to a mount, such as a wall mount, door mount, shelf mount or ceiling mount. FIG. 6I shows a mount 650*i* that may be used as a wall mount, with the mount 650*i* having a foldable angle bracket 680*i* with a support bar 682*i*, which may be a generally horizontal arm, pivotally connected by a pivot pin 684*i* to a mount arm 686*i* of the angle bracket 680*i*, with the mount arm being generally vertical and attachable, for example, by a bolt (not shown), to a wall or other surface. The pivot allows the support bar 682*i* to fold up against the wall when the angle bracket is not in use as the item holder mount.

FIG. 6I shows the cross-piece of the item holder 610*i* resting in a box forming a recess on the upper surface of a support bar 682*i*, but it may be understood that in certain embodiments the cross-piece may simply rest on the top surface of a support bar, or it may be releasably secured in any conventional manner to the support bar, such as with magnets, clips, snaps, or a hook and loop system such as a VELCRO™ fastener systems available from VIL Ltd. of London, UK, or the support bar and item holder may be releasably attachable using one of the cross-piece/support bar connection systems described below.

Figure 6J:
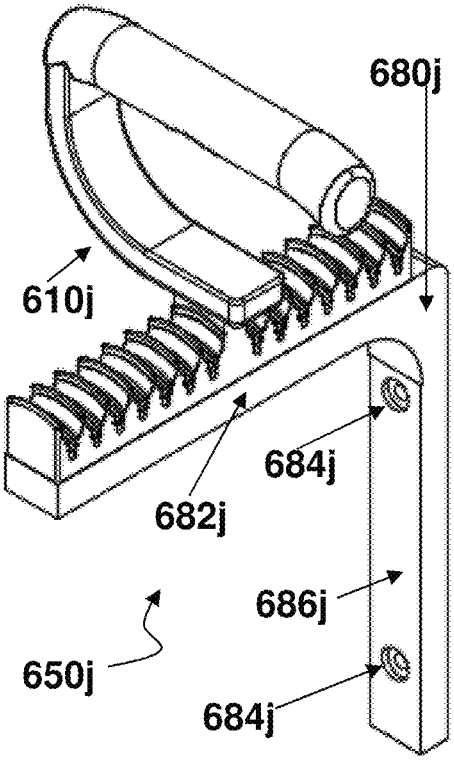

FIG. 6J shows an alternative wall mount 650*j* to which an item holder 610*j* may be attached. The wall mount 650*j* may have an angle bracket 680*j* with a support bar 682*j* rigidly connected or integral to a mount arm 686*j* which may be generally vertical and also may be attachable, for example, by one or more bolts 684*j*, to a wall or other surface. FIG. 6J shows the cross-piece of the item holder 610*k* resting on the top surface of the support bar 682*j*, but it may be understood that, as above described, in certain embodiments the cross-piece may be releasably secured in any convenient manner to the support arm 682*j*.

Figure 6K:
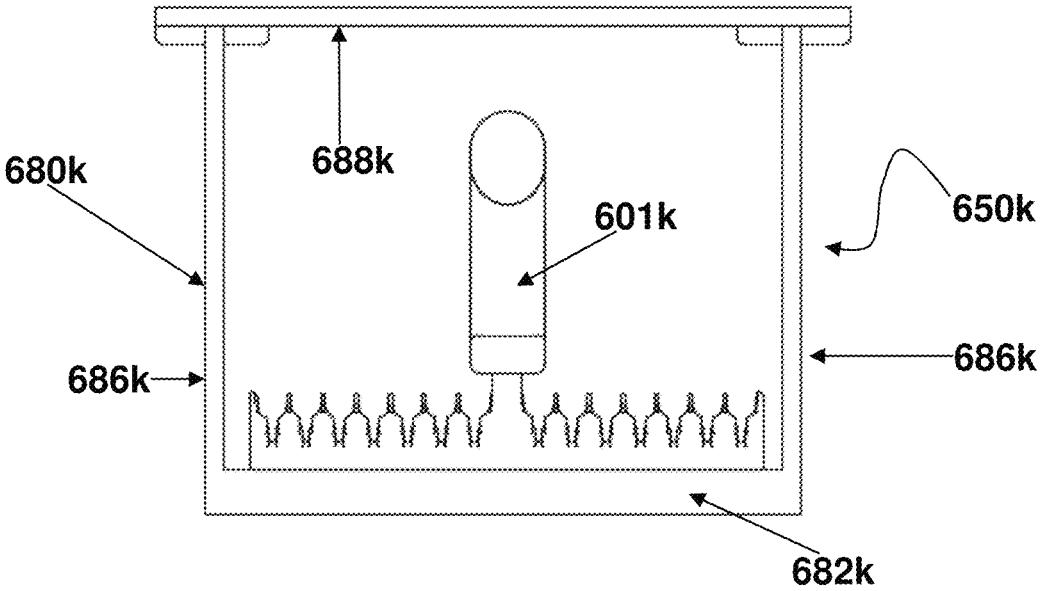

In certain embodiments, an item holder may be releasably connectable to a ceiling or shelf mount. FIG. 6K shows an item holding system mount 650*k* featuring a frame 680*k* having a pair of vertical sides 686*k* attached to a generally horizontal mount arm 688*k* attachable to a ceiling or shelf using any conventional manner, such as clips or bolts to drive into the ceiling or shelf. In certain embodiments (not shown), the pair of vertical sides 686*k* may constitute the mount arm, attachable to a shelf, ceiling, or a rod or disposable over a shelf or rod with clips or hanger hooks disposed on an upper end of each vertical side 686*k*.

The ceiling/shelf mount 650*k* may also feature a support bar 682*k* connected end-to-end to the bottom ends of the vertical sides 686*k*. In certain embodiments, such as the ceiling/shelf mount 650*k*, the support bar 682*k* may be attachable to a cross-piece of an item holder 601*k*, or it may be a separate element to which another support bar may be releasably attached. In other embodiments, the support bar may be permanently affixed to the vertical sides 686*k*; in another embodiment it may be removable from the vertical sides 686*k* so that it may be used as a support bar in another base. In still further embodiments, the vertical sides have end attachments to which a cross-piece or support bar may be releasably attached.

In most of the bases described above, generally horizontal support bars are releasably or permanently attached to generally vertical mount arms. Alternatively, the mount arm may be secured to any suitable article or element of an article and to which the support bar may be adjustably attached, no matter the orientation of the support bar to the element of the article to which the support bar is attached. The base may also have a locking element to secure the support bar into the desired orientation relative to the mount arm to maintain a preferred orientation of the cross-piece. Further, it may be understood that in certain embodiments, instead of having a support bar, a base may have a mount arm with a releasable clipping/locking system to attach a support bar thereto so that a support bar may be attached to the mount arm.

Cross-Piece/Support Bar Connections

An item holder's cross-piece may be releasably connectable to a support bar of a base by any conventional joinery system for releasably attaching two pieces together. One such connection system is a tongue-and-groove joinery system 700*a* (also known as a mortise and tenon system) shown in detail in FIG. 7A-1-7A-3. FIG. 7A-1 shows a cross-piece 720*a* having a rectangular cavity 722*a* (also referred to as a groove or a mortise) in its downwardly facing surface 724*a*, and a support bar 730*a* having a projection 732*a* (also referred to as a tongue or a tenon) on its upwardly facing surface 734*a* that is complementary in size and arrangement to the cavity 722*a* in the cross-piece 720*a*. The projection 732*a* is sized to fit snugly into the cavity 722*a* when the surfaces 724*a*, 734*a* are brought into contact with each other. As shown in FIG. 7A-2, the joinery system 700*a* may also be used to releasably attach a cross-piece and a support bridge, such as the support bridge 670 shown in FIG. 6D. In other embodiments, the cavity may be in the support bar and the projection in the cross-piece.

In other embodiments, a series of studs (having any convenient geometry) and complementary sockets may provide the releasable cross-piece/support bar connection. For example, FIG. 7B shows a cross-piece/support bar connection stud/socket system 700*b* in which a cross-piece 720*b* has a set of cavities or sockets 722*b* in its downwardly facing surface 724*b*, the studs in the illustrative but not necessarily preferred embodiment shown in FIG. 7B being circular in cross-section; and a support bar 730*b* has a set of studs 732*b* of circular cross-section on its upwardly facing surface 734*b*, with the studs complementary in cross-section, size, and arrangement to the sockets 722*b* in the cross-piece 720*b*. When the surfaces 724*b*, 734*b* are brought into contact with each other, the studs 732*b* may be positioned to fit snugly into the sockets 722*b*.

Figure 7C:
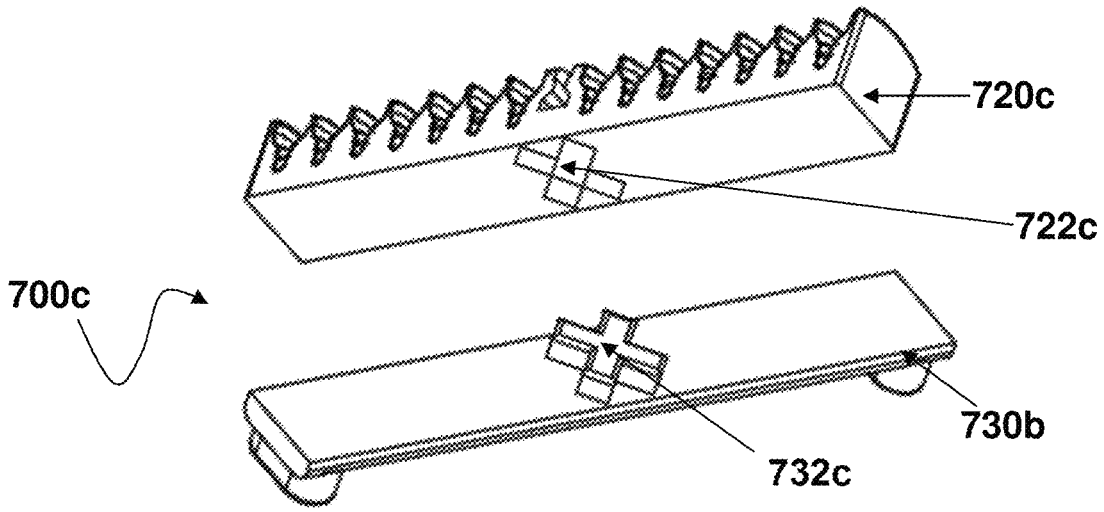

FIG. 7C shows a cross-piece/support bar cross-shaped stud/socket connection system 700*c* which is similar in design and operation to the cross-piece/support bar connection system 700*b*, with a difference between them being that the cross-piece/support bar connection system 700*c* has a cross-shaped socket 722*c* rather than the set of circular sockets 722*b*, and it has a cross-shaped stud 732*c* rather than the set of circular studs 732*b*. As before, in other embodiments, the sockets of FIGS. 7B, 7C may be in the support bar and the complementary studs in the cross-piece.

Figures 1, 7D:
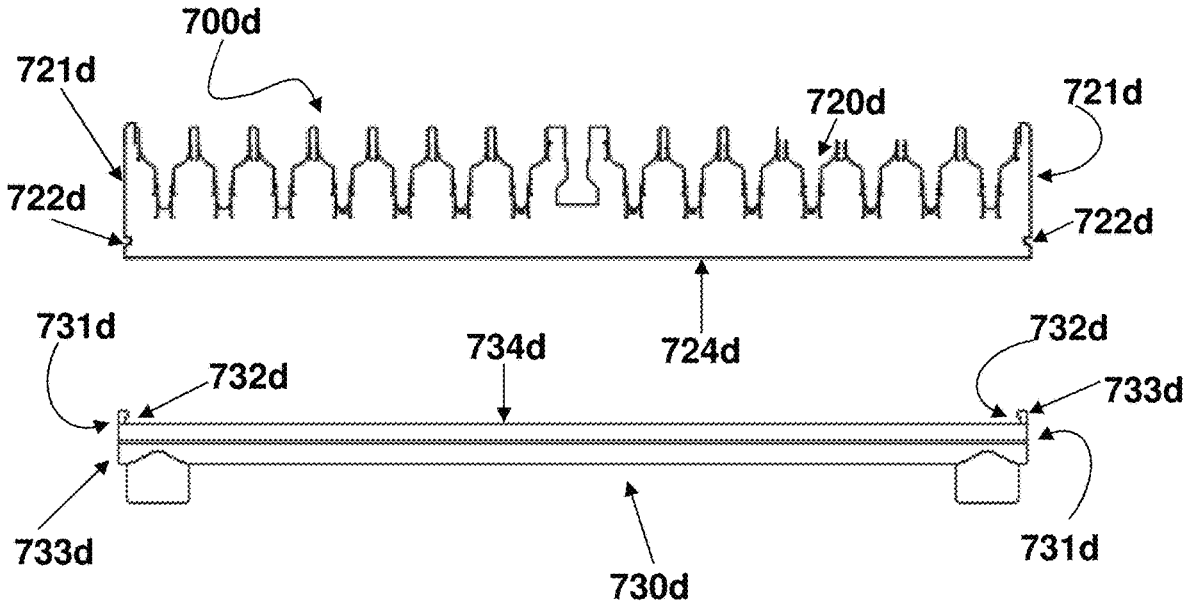
Figures 2, 7D:
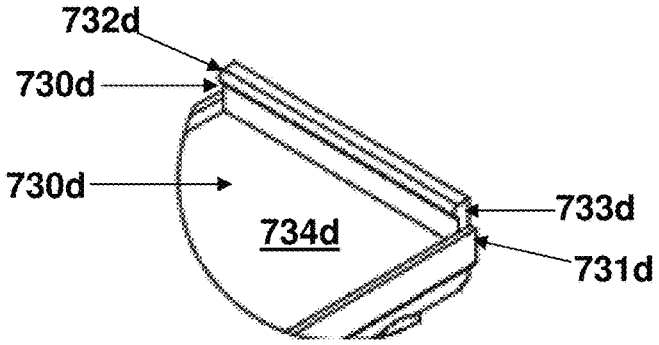

Another embodiment of a cross-piece/support bar click connection system 700*d* is shown in FIG. 7D-1, in which a cross-piece 720*d* may have a pair of grooves 722*d*, one on each end 721*d* of the cross-piece 720*d*, and a bottom surface 724*d*. The cross-piece/support bar clip connection system 700*d* also has a support bar 730*d* with a panel 733*d* on each end 731*d* of the support bar 730*d*, upwardly extending from the upper surface 734*d* of the support bar and with an inwardly-facing flange 732*d* on the top edge of each panel 733*d*. The flanges 732*d*, shown in more detail in FIG. 7D-2, may be complementary in thickness and position to the grooves 722*d* in the cross-piece 720*d* so that, when the surfaces 724*d*, 734*d* are brought into contact with each other, the panels are pushed upward along the ends of the cross-piece 720*d* until the flanges 732*d* reach the grooves 722*d* and click into the grooves.

Support Bridge to Support Bar Connections

A support bar may be releasably connectable to a support bridge end-to-end. As noted above, a cross-piece, item holder, item carrier, or another support bar may operate as a support bridge. The support bridge-to-support bar connection may be made by any conventional system for releasably attaching two pieces together. One such connection system 800, involving a locking click-in tongue and groove joint 890, is shown in detail in FIGS. 8A, 8B.

The support bridge-to-support bar connection system 800 has a support bar 830 and a support bridge 870 that may be joined end-to end with the locking click-in tongue and groove joint 890. At least one end 831*a*, 831*b* of the support bar 830 may have a groove extending front to almost the rear side surface of the support bar; and at least one end 871*a*, 871*b* of the support bridge 870 may have a tongue extending front to back, with the tongue shaped to be complementary with the groove. The embodiment of FIGS. 8A, 8B shows grooves disposed in both ends 831*a*, 831*b* and tongues disposed in both ends 871*a*, 871*b*, with a groove 832*b*, 832*a*, sized and arranged to receive and contain a tongue 872*a*, 872*b* respectively, and, except for the heights of the tongues and grooves as described below, with the tongues 872*a*, 872*b* complementary in shape with the grooves 832*b*, 832*a*, respectively.

The upper, bottom, front and rear surfaces of the support bridge 870 generally may form a rectangular prism, with certain of the edges rounded off, with the surfaces of the ends 871*a*, 871*b* forming parallel planes, and with the upper, front and rear surfaces of the support bridge 870 (including the upper, front and rear surfaces of the tongues 872*a*, 872*b*) being generally planar. In addition, referencing the tongue 872*b* (with recognition that, in the embodiment shown in FIG. 8A, the tongue 872*a* has the same geometry as the tongue 872*b*), the rear surface of the tongue 872*b* may extend from the upper surface of the support bridge a selected distance to a point 874*b*, and the bottom surface of the tongue may extend from the point 874*b* at an incline downwardly toward the front surface of the support bridge. Finally, rectangular cutouts 837*a*, 837*b* are cut from the bottom corners of the tongues 872*a*, 872*b*, respectively.

As noted above, the grooves 832*a*, 832*b* of the support bar 830 are complementary in length and depth to the length and depth of the tongues 872*b*, 872*a*, respectively, of the support bridge 870. Referencing the groove 832*b* (with recognition that, in the embodiment shown in FIG. 8A, 8B, the bottom edge of the groove 832*b* is complementary in shape to the bottom edge of the tongue 832*a*, including the slight downward rear-to-front angle of the bottom edge of the tongue and also including an upwardly extending lip 837*a* on the front surface of the support bar 830 that is complementary in height, length and depth to the cutout 877*b*. One of skill in the art will appreciate that the locking tongue and groove joint may be embodied in several ways. In the embodiment shown FIGS. 8A, 8B, the tongue is disposed on the support bridge and the groove is disposed in the support bar. Alternatively, the tongue may be disposed on the support bar and the groove may be disposed in the support bridge.

Figure 8A:
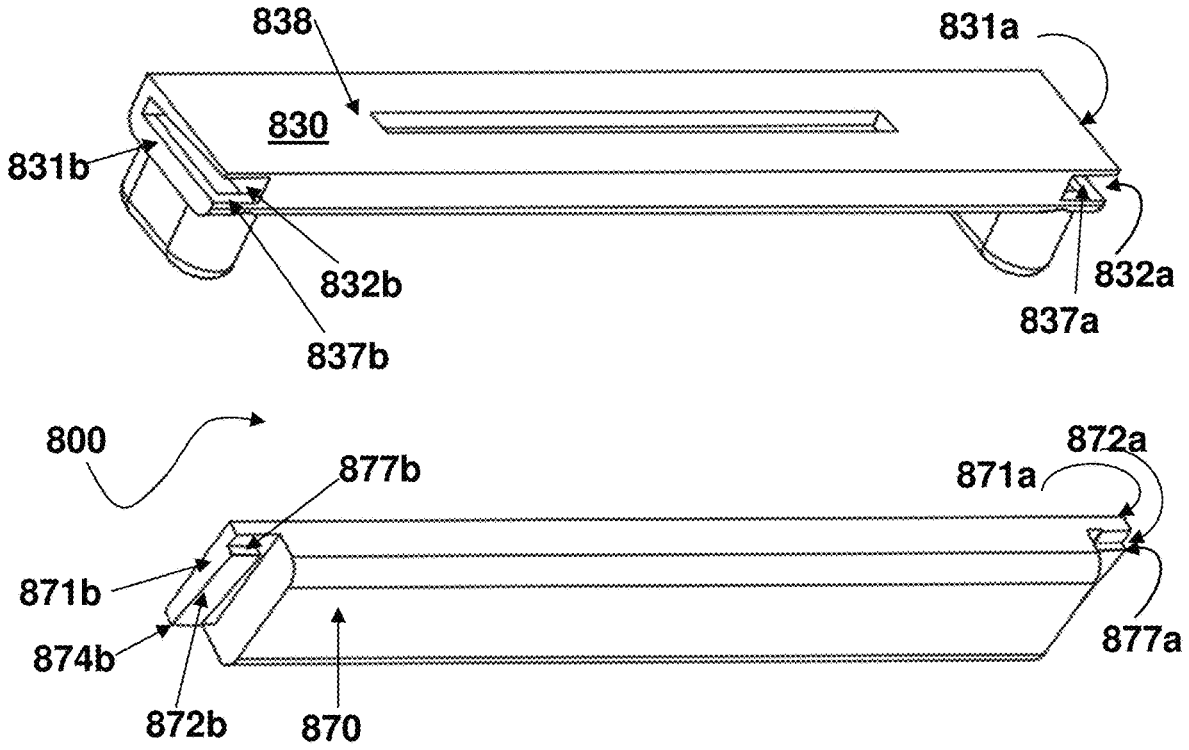
FIG. 8A is a perspective view of components of an unassembled locking click-in tongue and groove support bridge-to-support bar connection system 800.
Figure 8B:
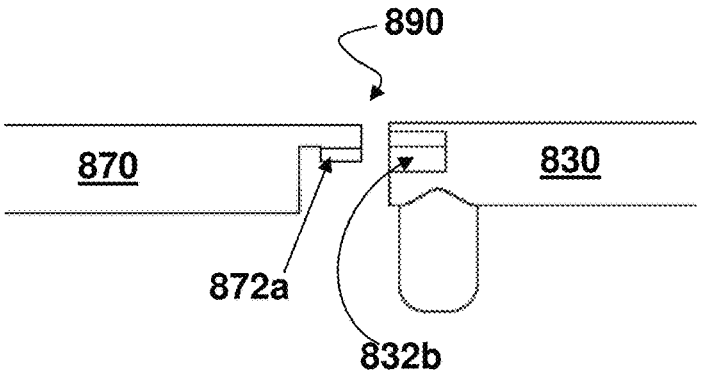
FIG. 8B is a side view of the locking click-in tongue and groove support bridge-to-support bar connection 800 shown in FIG. 8A positioned to be assembled into a locking click-in tongue and groove joint 890.

In addition, in the embodiment shown FIGS. 8A, 8B, the upper surface of the tongue is coplanar with the upper surface of the support bridge, and the support bar groove is contained within the end 831*a* of the support bar, rendering the groove upper surface lower than the support bridge upper surface 838, which makes the support bridge upper surface not coplanar with the support bar upper surface when the tongue is fit into the groove. Alternatively, a designer may choose to make the upper surface of the support bridge coplanar with the upper surface of the support bar by disposing the tongue lower in the end of the support bridge and disposing the groove such that the tongue upper surface is lower than the upper surface of the support bridge.

Returning to the embodiment in FIGS. 8A, 8B, the groove 832*b* also is provided with a greater height within the support bar 830*b* than the height of the tongue 872*a* on the upper surface of the support bridge. In the embodiment shown in FIGS. 8A, 8B, the support bar 830 and support bridge 870 are joined by inserting the tongue 872*a* into the groove 832*b* to the length of the groove 832*b*. When the tongue 872*a* has been fully inserted into the groove 832*b*, the tongue 872*a* may be pushed downward into the groove 832*b*, clicking the tongue into the groove behind the lip 837*b*, thus locking the support bridge into the support bar. Upon joinder of the support bridge and support bar, the front surface of the support bar 830 is coplanar with the front surface of the support bridge 870.

Other Suitable Connections

Figure 9A:
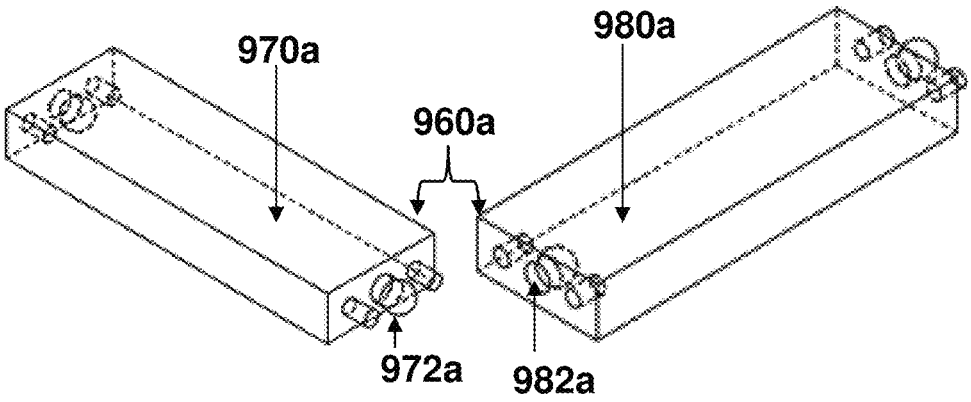
FIGS. 9A-9G are views of alternative embodiments of connectors for support bridge/support bar, support bar/item holder, and item holder/support bridge connections combinations, with FIG. 9A being a perspective view of components of an unassembled snap connector system 960*a* with shared pegs, FIG. 9B being a perspective view of components of an unassembled first tongue and groove connector system 960*b*, FIG. 9C being a side view of a tongue component of a second tongue and groove connector system 960*c*, FIG. 9D being a side view of a groove component of a first tongue and groove friction fit connector system 960*d*, FIG. 9E being a perspective view of components of a second tongue and groove friction fit connector system 960*e*, FIG. 9F being a side view of an assembled hook and loop connector system 960*f* applied to a releasably attached cross-piece 920*f* of an item carrier 901*f* and a support bar 930*f*, and FIG. 9G being a side view of components of a magnetic connector system 960*g*.
Figure 9B:
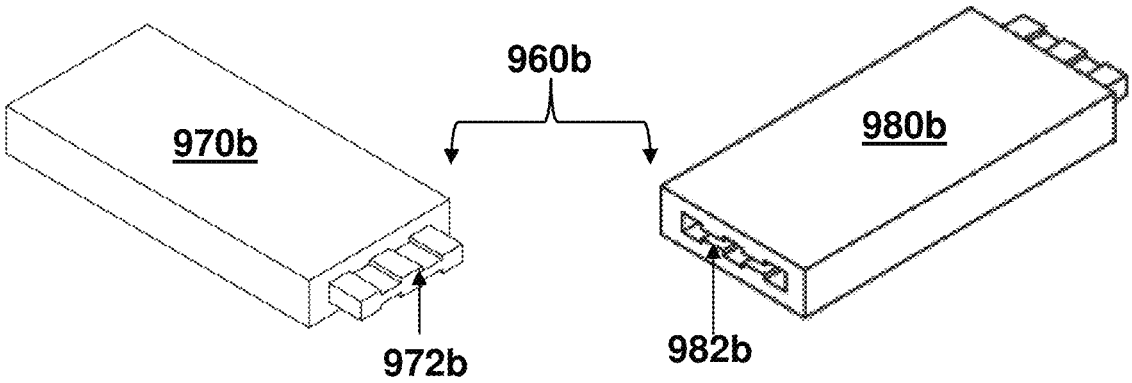
Figure 9C:
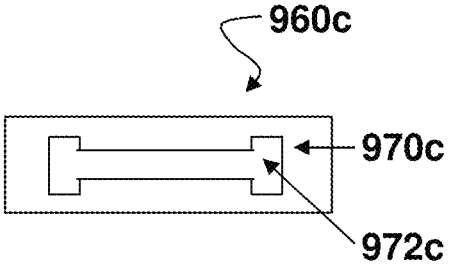

Any conventional systems for connection of support bar/support bridge, support bar/item holder, and item holder/support bridge combinations may be used to join the elements of the systems described herein, so long as the materials of such systems are suitable for use in the systems described herein. For example, suitable connection systems include but are not limited to the following joinery systems:

- A shared pegs snap connector system 960*a*, as shown in FIG. 9A, has a snap connector component 970*a* with shared pegs 972*a* on one end, and a complementary receiving component 980*a* for the snap connector with shared peg holes 982*a* on one end and that are complementary and arranged to receive the pegs 972*a* when the ends of the components 970*a*, 980*a* are disposed against each other.
- A tongue and groove connector system 960*b* as shown in FIG. 9B, has a tongue component 970*b* on one end, in which the tongue 972*b* has a generally rectangular shape with three teeth extending outwardly from the edge on each side of the tongue, and a groove component 980*b* with a groove 982*b* on one end, with the groove 982*b* being complementary and arranged to receive the tongue 972*b* when the ends of the components 970*b*, 980*b* are disposed against each other.
- A second tongue and groove connector system 960*c*, as shown in FIG. 9C, has a tongue component 970*c* with a tongue 972*c* on one end, in which the tongue has a generally rectangular shape with teeth extending outwardly from the edge on each side of the tongue.

Figure 9D:
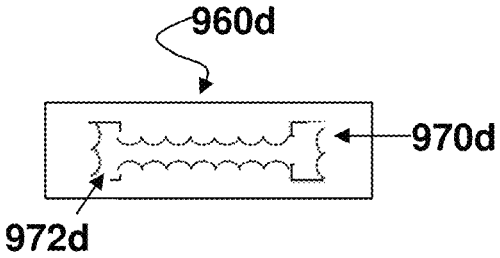

A friction fit connector system 960*d*, as shown in FIG. 9D, has a tongue component 970*d* with a tongue 972*d*, in which the tongue 972*d* has rough edges to enhance the friction fit.

Figure 9E:
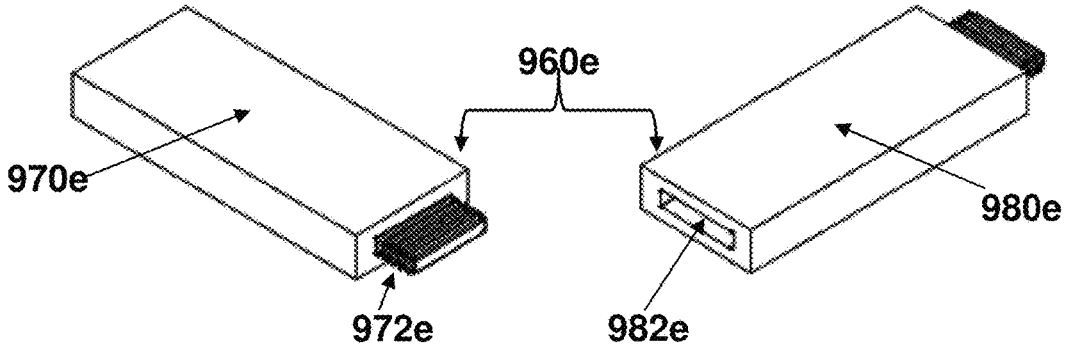

A tongue and groove friction fit connector system 960*e*, as shown in FIG. 9E, has a tongue component 970*e* with a tongue 972*e* on one end, in which a tongue 972*e* has a series of longitudinal ribs to provide a friction fit in the groove component 980*e*, which has a groove 982*e* that is complementary and arranged to receive the tongue 972*e* when the ends of the components 970*e*, 980*e* are disposed against each other.

Figure 9F:
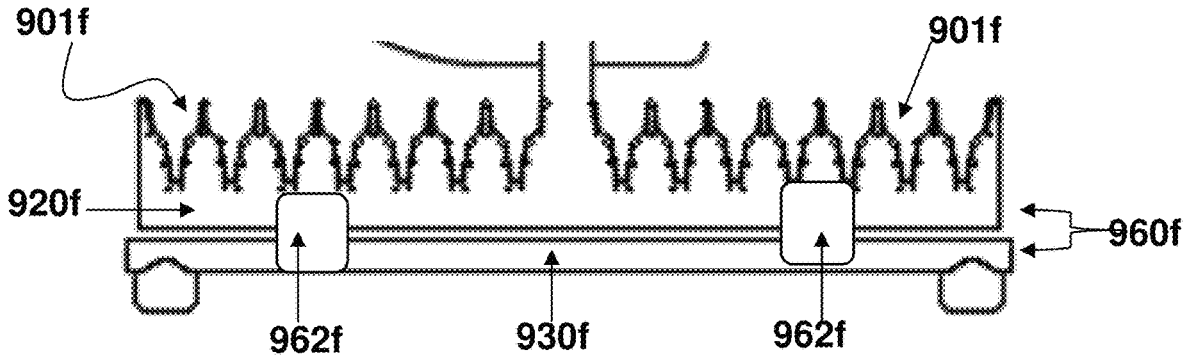

A hook and loop connector system 960*f*, as shown in FIG. 9F, has one or more hook and loop connectors 962*f*, such as the VELCRO™ fastener systems available from VIL Ltd. of London, UK, to provide or reinforce the connection of support bar/support bridge, support bar/item holder, and item holder/support bridge combinations, shown in FIG. 9F as applied to the cross-piece 920*f* of an item holder 901*f* and a support bar 930*f*.

Figure 9G:
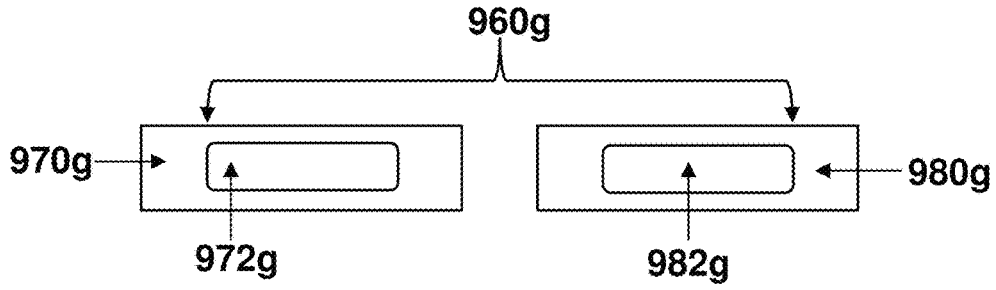

A magnetic fastener system 960*g*, as shown in FIG. 9G, has a magnet 972*g* disposed on one connector component 970*g* and an element 982*g* formed of a material that is attracted to magnets and that is disposed on a second connector component 980*g*, with the element 982*g* arranged to join with the magnet 972*g* when the components 970*g*, 980*g* are disposed against each other, for providing or reinforcing the connection of support bar/support bridge, support bar/item holder, and item holder/support bridge combinations, with the magnetic connection particularly suitable for when the components are brought together with one atop the other.

It may be seen that the embodiments described herein for transportation and storage of items disclosed here may be used to greatly improve the convenience of transporting items such as clothing from one location to another, and to keep such items organized and unrumpled for short or long periods of time. The systems, devices, and methods for organizing, transporting, and storing items create new storage location and transportation options due to their flexibility for fitting into spaces that may not be normally considered available for temporary or longer-term storage. They increase the ability to transport items from various convenient temporary storage locations to other locations using ergonomically designed carriers that can be sized for persons with differing physical sizes and abilities. They provide storage capacity flexibility using interconnecting components, and provide the ability to integrate common existing item hangers and common storage systems into new systems, devices, and methods for organizing, transporting, and storing items, essentially enhancing control of items when being carried.

One of skill in the art will appreciate that the above-described stages may be embodied in several ways. Although the disclosed components have been described above as being separate units, one of ordinary skill in the art will recognize that functionalities provided by one or more units may be combined. As one of ordinary skill in the art will appreciate, one or more of units may be optional and may be omitted from implementations in certain embodiments. For example, it may be understood that several of the embodiments disclosed herein in which item carriers are used may be formed using a cross-piece without the handle (and vice versa). Further, mounts may be developed for the item holders in which the mount lacks a support arm, with the item holder cross-piece releasably attachable to the vertical arm of the mount.

In addition, while the embodiments above have been described with reference to transporting and storing clothing, it is to be understood that the systems, devices and methods described herein are not limited to transporting and storing clothing. Instead, the embodiments described herein may be used to transport or store any materials, especially such as are required for use and then temporary storage until the end of a project, such as any gardening equipment, sporting goods, home improvement or cleaning supplies, kitchen utensils, electrical cords, rope, wires or jewelry.

The foregoing descriptions have been presented for purposes of illustration. It is not exhaustive and does not limit the invention to the precise forms or embodiments disclosed. Modifications and adaptations of the invention will be apparent to those skilled in the art from consideration of the specification and practice of the disclosed embodiments. For example, the described implementations may be implemented in a variety of materials, sizes and shapes, and be arranged differently than the figures illustrate. It is intended that the specification and examples be considered as exemplary only, with a true scope and spirit of the invention being indicated by the following claims.

The invention claimed is:

1. An item holding system, comprising:

an item holder having a cross-piece extending generally straight and horizontally across the item holder, the cross-piece having a length from a near cross-piece end to a far cross-piece end, and having one or more partitions disposed along the cross-piece length from the near cross-piece end to the far cross-piece end, wherein the cross-piece has a first partition that is sized to contain at least one of the plurality of items therewithin, with:

a first divider extending upwardly from a floor of the cross-piece, at least one portion of the first divider having a first selected height, and a second divider extending upwardly from the floor of the cross-piece, at least one portion of the second divider having a second selected height, and spaced a selected width on the cross-piece from the first divider;

wherein the cross-piece has a mid-section between the first divider and the second divider and extending upwardly from the floor of the cross-piece a third selected height that is less than the first selected height and the second selected height; and a base arranged to have the item holder releasably positioned thereon or thereto and to receive and support the item holder, wherein the base has an upwardly facing surface thereof, wherein the upwardly facing surface is sized and arranged to be directly or indirectly releasably attachable to a downwardly facing surface of the cross-piece.

2. The item holding system of claim 1, wherein the one or more partitions are disposed on an upper surface of the cross-piece;

wherein the first divider is attached to the cross-piece and extends upwardly from the upper surface of the cross-piece, wherein the first divider has a first surface facing the second divider and a first set of tiers along the first surface, with the first set of tiers having a first tier and a second tier, the first tier disposed between the cross-piece and the second tier;

wherein the second divider is attached to the cross-piece, extending upwardly from the upper surface of the cross-piece, and spaced the selected width on the cross-piece from the first divider;

wherein the second divider and the first tier have a first distance therebetween;

wherein the second divider and the second tier have a second distance therebetween; and wherein the first distance is less than the second distance.

3. The item holding system of claim 2, wherein the second divider has a second surface with tiers that face the first surface of the first divider and that correspond in position and height to the first tier and the second tier in the first set of tiers on the first surface of the first divider, with the first distance comprising a distance along the cross-piece between the first tier of the first surface and a corresponding first tier on the second surface, and with the second distance comprising a distance between the second tier of the first surface and a corresponding second tier on the second surface.

4. The item holding system of claim 2:

wherein the first divider has a cross-section of a tiered pyramid, with tiers that decrease in width along the cross-piece across the first divider from a bottom tier at the cross-piece to a top tier;

wherein the second divider has tiers that correspond in position, width, and height to the tiers on the first divider;

wherein corresponding tier pairs on the first divider and the second divider have distance therebetween that increases based on a height of the corresponding tier pairs from the surface of the cross-piece, the distances between corresponding tier pairs defining spaces of increasing width above the upper surface of the cross-piece.

5. The item holding system of claim 1, further comprising a handle connected to the cross-piece, the handle with a far end, a near end that is attached or attachable to the cross-piece, and a hand-graspable section between the far end and the near end, the hand-graspable section being generally straight and elongated.

6. The item holding system of claim 5, wherein the hand-graspable section of the handle is disposable parallel to the cross-piece along at least a portion of the crosspiece.

7. The item holding system of claim 5, wherein the handle is releasably attachable to the cross-piece.

8. The item holding system of claim 5, wherein the hand-graspable section of the handle is disposable perpendicular to a plane that is defined by the cross-piece and a connector between the handle and the cross-piece.

9. The item holding system of claim 5, wherein the item holder has a rotatable connection of the handle relative to the cross-piece, with the rotatable connection arranged to allow rotation of the handle around a vertical axis extending through the cross-piece.

10. The item holding system of claim 9, wherein the rotatable connection is arranged to provide the user with a desired orientation of the handle relative to the cross-piece, with the desired orientation being selectable by the user.

11. The item holding system of claim 10, wherein the rotatable connection is arranged to move through a selected number of positions of the handle relative to the cross-piece.

12. The item holding system of claim 9, further comprising:

a post arranged to be joined at the handle, a cam between the post and the cross-piece, the cam having a set of cam teeth extending outwardly around the cam's exterior circumference, the cam teeth being in number the selected number of positions of the handle relative to the cross-piece, and a flexible inset integrated into or fixed to the cross-piece, the inset having a series of inner arches being in number the selected number of positions of the handle relative to the cross-piece, and sized:

to squeeze between the cam teeth and hold the cam in the inset in a selected angular position relative to the cross-piece when the cam is fitted into the inset, and to displace the position of the cam in the inset and hold the cam in the inset into a new angular position relative to the cross-piece when the handle is rotated around the vertical axis extending through the cross-piece.

13. The item holding system of claim 1, wherein the item holder further comprises a handle with a far end, a near end that is releasably attachable to the cross-piece, and a generally straight and elongated hand-graspable section between the far end and the near end of the handle, wherein the handle is sized and arranged according to ergonomic principles for hand-held transporting of the first plurality of items from one location to another location, and wherein the hand graspable section is arranged:

to support a hand of a user grasping the handle and hand-carrying the item holder, and to slip into contact over and be releasably suspended from an element at the one location so that the item holder is caused to be releasably suspended from the element.

14. The item holding system of claim 1, wherein the base further comprises a mount that is attachable to an article, said mount having: a mount arm to which the cross-piece is attachable directly or indirectly and that is attachable to the article.

15. The item holding system of claim 1, wherein the base further comprises a stand having a leg with a near end and a far end, wherein one end of the cross-piece is releasably attachable directly or indirectly to the near end of the leg.

16. The item holding system of claim 15, wherein the stand further comprises a footing attachable to the far end of the leg and having a set of contact points that, when the footing is disposed on a surface, provides the leg with a multi-point contact with the surface.

17. The item holding system of claim 1, further comprising an item holder/base connection system with a first connector element and a second connector element complementary in size and arrangement to the first connector element, wherein the first connector element is arranged on a downwardly facing surface of the item holder and the second connector element is arranged on an upwardly facing surface of a support bar on the base; and wherein the first connector element and the second connector element are arranged to fit snugly together in a locking but releasable relationship.

18. The item holding system in claim 17, wherein the first connector element comprises a cavity in the downwardly facing surface of the item holder; and wherein the second connector element comprises a projection extending from the upwardly facing surface of the support bar and sized to fit snugly in the cavity.

19. The item holding system of claim 1, further comprising:

a generally straight support bar with:

a length from a near support bar end to a far support bar end, a downwardly-facing surface, and an upwardly-facing surface arranged to be releasably connectable to a complementarily arranged downwardly facing surface of the cross-piece;

wherein the base is arranged to receive and support the item holder, wherein the base has an upwardly facing surface arranged to be releasably positioned on or to the downwardly-facing surface.

20. The item holding system of claim 19, wherein the support bar comprises a first support bar having a length from a near first support bar end to a far first support bar end;

further comprising a generally straight second support bar having a length from a near second support bar end to a far second support bar end; and wherein the item holding system further comprises a generally straight support bridge arranged to releasably attach the first support bar to the second support bar along their lengths, with the support bridge:

releasably attachable to the far first support bar end at the near support bridge end, and releasably attachable to the near second support bar end at the far support bridge end.

21. The item holding system of claim 9, further comprising a connection member between the cross-piece and the handle, the connection member having a series of flexible, flanged fingers extending downwardly into the cross-piece, wherein a selected finger has an outwardly extending flange at a bottom of the finger, and a retaining element with a protrusion formed on the outwardly facing surface of the finger above the flange, and a complementarily shaped recess in the cross-piece sized to receive the series of flexible, flanged fingers, wherein the fingers are arranged to flex into the recess and to expand therein and the retaining elements are arranged to press into the cross-piece to fit the connection member snugly and rotatably into the cross-piece to allow the handle to rotate around the vertical axis extending through the cross-piece when the connection member is pushed into the cross-piece.

22. The item holding system of claim 5, wherein the handle is sized and arranged according to ergonomic principles for hand-held transporting of the first plurality of items.

23. The item holding system of claim 22, wherein the hand-graspable section further comprises a bottom surface with an indentation sized to receive an element from which the item holder may be suspended.

24. The item holding system of claim 22, further comprising a handle hook disposed on the handle far end and extending downwardly toward the cross-piece, wherein the handle hook is sized and arranged to reduce slipping of the item holder off of an element from which the item holder may be suspended.

25. A method of holding items, comprising:

a user holding and balancing a plurality of items across a cross-piece extending generally straight and horizontally across an item holder, and arranged to hold one or more items thereacross;

releasably attaching the cross-piece to a support bar on a first base sized and arranged to support the item holder;

transporting items on the cross-piece by hand from a first base at one location to a second base at another location;

disposing one or more partitions along the cross-piece from a near cross-piece end to a far cross-piece end with one divider projecting and another divider, both extending upwardly from a floor of the cross-piece;

disposing the plurality of items in the one or more partitions along the cross-piece from the one divider to the another divider, wherein a first partition of the one or more partitions has:

a first divider with at least one portion of the first divider having a first selected height, the first divider extending upwardly from an upper surface of the cross-piece, and a second divider with at least one portion of the second divider having a second selected height and extending upwardly from the upper surface a selected partition width apart on the upper surface from the first divider, with the cross-piece having a mid-section between the first divider and the second divider and extending upwardly from the floor of the cross-piece a third selected height that is less than the first selected height and the second selected height; and wherein said disposing further comprises releasably securing a first item into the first partition between the first divider and the second divider;

sizing the first partition to contain at least one of the plurality of items therewithin;

attaching the cross-piece to or resting the cross-piece in the first base;

removing the cross-piece from the first base and hand-carrying the cross-piece to the second base; and attaching the cross-piece to or resting the cross-piece in the second base.

26. The method of claim 25, further comprising sizing the one or more partitions to snugly contain at least one of the plurality of items therewithin, wherein containing the at least one of the plurality of items further comprises snugly securing the at least one of the plurality of items in the one or more partitions.

27. The method of claim 25, wherein the user holding and balancing further comprises the user grasping a handle connected to the cross-piece, wherein the handle further comprises a far end, a near end that is releasably attachable to the cross-piece, and a generally straight and elongated hand-graspable section between the far end and the near end of the handle, and wherein the grasping the handle further comprises the user grasping the handle by the hand-graspable section of the handle to hand-carry the cross-piece loaded with a first plurality of items thereacross;

further comprising sizing and arranging the handle according to ergonomic principles for hand-held transporting of the first plurality of items from one location to another location; and further comprising sizing and arranging the hand graspable section:

to support a hand of a user grasping the handle and hand-carrying the item holder, and to slip into contact over and be releasably suspended from an element at the one location so that the item holder is caused to be releasably suspended from the element.

28. The method of claim 25, further comprising positioning the item holder on a generally horizontal support bar on a base, the positioning further comprising releasably attaching the support bar to the cross-piece.

29. An item holder comprising:

a cross-piece extending generally straight and horizontally across the item holder, wherein the cross-piece has a length from a near cross-piece end to a far cross-piece end, and one or more partitions disposed along the cross-piece length from the near cross-piece end to the far cross-piece end, wherein the cross-piece has a first partition with:

a first divider extending upwardly from a floor of the cross-piece, at least one portion of the first divider having a first selected height, and a second divider extending upwardly from the floor of the cross-piece, at least one portion of the second divider having a second selected height, and spaced a selected width on the cross-piece from the first divider;

wherein the cross-piece has one divider extending upwardly from the floor of the cross-piece at the near cross-piece end, and another divider extending upwardly from the floor of the cross-piece at the far cross-piece end;

a handle connectable to the cross-piece, the handle with a far end, a near end that is attachable to the cross-piece, and a hand-graspable section between the far end and the near end; and a connection member between the cross-piece and the handle, the connection member arranged to attach the near end of the handle to the cross-piece and to allow rotation of the handle around a vertical axis extending through the cross-piece, wherein the connection member further comprises:

a series of flexible, flanged fingers extending downwardly into the cross-piece, wherein a selected finger has an outwardly extending flange at a bottom of the finger, and wherein the retaining element has a protrusion formed on the outwardly facing surface of the finger above the flange, and a complementarily shaped recess in the cross-piece sized to receive the series of flexible, flanged fingers, wherein the fingers are arranged to flex into the recess and to expand therein and the retaining elements are arranged to press into the cross-piece to fit the connection member snugly and rotatably into the cross-piece to allow the handle to rotate around a vertical axis extending through the cross-piece when the connection member is pushed into the cross-piece.

30. An item holder comprising:

a cross-piece extending generally straight and horizontally across the item holder, wherein the cross-piece has a length from a near cross-piece end to a far cross-piece end, and one or more partitions disposed along the cross-piece length from the near cross-piece end to the far cross-piece end, wherein the cross-piece has a first partition with:

a first divider extending upwardly from a floor of the cross-piece, at least one portion of the first divider having a first selected height, and a second divider extending upwardly from the floor of the cross-piece, at least one portion of the second divider having a second selected height, and spaced a selected width on the cross-piece from the first divider;

wherein the cross-piece has one divider extending upwardly from the floor of the cross-piece at the near cross-piece end, and another divider extending upwardly from the floor of the cross-piece at the far cross-piece end;

a handle connectable to the cross-piece, the handle with a far end, a near end that is attachable to the cross-piece, and a hand-graspable section between the far end and the near end; and a connection member between the cross-piece and the handle, the connection member arranged to attach the near end of the handle to the cross-piece and to allow rotation of the handle around a vertical axis extending through the cross-piece, wherein the connection member between the cross-piece and the handle is arranged to attach the near end of the handle to the cross-piece through an aperture extending vertically through at least a portion of the cross-piece or through at least a portion of the near end of the handle, and to allow rotation of the handle around a vertical axis extending through the aperture; and further comprising a retaining element arranged to hold the handle snugly and rotatably onto the cross-piece when the handle and cross-piece are connected by connection member through the aperture wherein the aperture extends vertically through the at least a portion of the cross-piece; and wherein the cross-piece has a second complementarily shaped recess in the inwardly facing surface of the aperture, the second complementarily shaped recess sized and positioned to receive the retaining element.

31. The item holder of claim 30, wherein the retaining element further comprises a protrusion formed on the outwardly facing surface of the connection member, and wherein the second complementarily shaped recess is sized and positioned to receive the protrusion.

32. The item holder of claim 31, wherein the protrusion is retractable toward the interior of the connection member and when not retracted is deployable with spring force to hold the connection member within the second complementarily shaped recess.

33. The item holder of claim 32, wherein the retractable protrusion comprises a ring of retractable protrusions formed around a circumference around the outwardly facing surface of the connection member;

wherein the second complementarily shaped recess comprises a ring of semi-circular depressions extending around the inwardly facing surface of the cross-piece aperture, with the ring of semi-circular depressions sized and shaped to fit and contain the ring of protrusions in the second complementarily shaped recess; and wherein the second complementarily shaped recess is further arranged to lock the connection member into a connective fit with the cross-piece when the connection member is twisted in a first twist relative to the crosspiece in a direction around the circumference of the outwardly facing surface of the connection member to contain the ring of protrusions into the ring of semi-circular depressions, and to unlock the connective fit when the connection member is twisted in a second twist relative to the cross-piece in the direction around the circumference of the outwardly facing surface of the connection member to remove the ring of protrusions from the ring of semi-circular depressions.

34. The item holder of claim 30, wherein the connection member further comprises one or more flexible flanges formed on and extending away from the outwardly facing surface of the connection member; and wherein the cross-piece has a first complementarily shaped recess in the inwardly facing surface of the cross-piece aperture, the first complementarily shaped recess sized and positioned to receive the one or more flanges; and wherein the flanges are arranged to flex inward toward a center of the connection member to allow the outwardly facing surface of the connection member to fit into the inwardly facing surface of the cross-piece aperture and then flex outward to extend beyond the outwardly facing surface of the connection member to fit snugly into the first complementarily shaped recess and to contain the one or more flanges within the cross-piece.

35. The item holder of claim 30, wherein the aperture extends vertically through the at least a portion of the cross-piece;

wherein the connection member further comprises one or more flexible, flanged fingers extending downwardly from the connection member, wherein a selected finger has an outwardly extending flange at a bottom of the finger extending away from the outwardly facing surface of the connection member, and wherein a first complementarily shaped recess in the inwardly facing surface of the cross-piece aperture is sized and positioned to receive the one or more flexible, flanged fingers, wherein the fingers are arranged to flex and fit the connection member snugly into the first complementarily shaped recess and to contain the one or more flanged fingers within the cross-piece.

* * * * *